US009828010B2

(12) United States Patent
Otsubo et al.

(10) Patent No.: US 9,828,010 B2
(45) Date of Patent: Nov. 28, 2017

(54) SYSTEM, METHOD AND COMPUTER SOFTWARE CODE FOR DETERMINING A MISSION PLAN FOR A POWERED SYSTEM USING SIGNAL ASPECT INFORMATION

(75) Inventors: Tom Otsubo, Oak Grove, MO (US); Wolfgang Daum, Erie, PA (US); Craig Alan Stull, Kansas City, MO (US); Gregory Hann, Odessa, MO (US); Phillip Danner, Mukilteo, WA (US)

(73) Assignee: General Electric Company, Schenectady, NY (US)

( * ) Notice: Subject to any disclaimer, the term of this patent is extended or adjusted under 35 U.S.C. 154(b) by 2639 days.

(21) Appl. No.: 12/270,160

(22) Filed: Nov. 13, 2008

(65) Prior Publication Data

US 2009/0076667 A1 Mar. 19, 2009

Related U.S. Application Data

(63) Continuation-in-part of application No. 11/765,443, filed on Jun. 19, 2007, which is a continuation-in-part (Continued)

(51) Int. Cl.

| | |
|---|---|
| ***G01M 17/00*** | (2006.01) |
| ***G06F 7/00*** | (2006.01) |
| ***B61L 3/00*** | (2006.01) |

(52) U.S. Cl.

CPC ..... *B61L 3/006* (2013.01)

(58) Field of Classification Search

CPC ..... B61L 3/221; B61L 3/008; B61L 3/106; B60L 15/40; B60L 2200/26;

(Continued)

(56) References Cited

U.S. PATENT DOCUMENTS

| | | | |
|---|---|---|---|
| 2,059,160 | A | 10/1936 | Wintsch |
| 2,104,601 | A | 1/1938 | Young |

(Continued)

FOREIGN PATENT DOCUMENTS

| | | | |
|---|---|---|---|
| AU | 2007202928 | A1 | 10/2007 |
| AU | 2010256020 | A1 | 12/2011 |

(Continued)

OTHER PUBLICATIONS

Juli-Ann Luther et al., filed Apr. 24, 2015, U.S. Appl. No. 14/696,124.

(Continued)

*Primary Examiner* — Khoi Tran
*Assistant Examiner* — Jorge Peche
(74) *Attorney, Agent, or Firm* — Global Patent Operation; John A. Kramer

(57) ABSTRACT

A mission planner system for a powered system, the mission planner system including a receiving device to collect aspect information as the powered system performs a mission, said aspect information being received from a remote location, a processor to determine a speed limit based at least in part on the aspect information, and a control system connected to the powered system to operate the powered system in response to the speed limit. A method and a computer software code for determining the mission plan with aspect information obtained from a remote location during the mission are also disclosed.

8 Claims, 2 Drawing Sheets

Related U.S. Application Data of application No. 11/669,364, filed on Jan. 31, 2007, which is a continuation-in-part of application No. 11/385,354, filed on Mar. 20, 2006.

(60) Provisional application No. 60/988,191, filed on Nov. 15, 2007, provisional application No. 60/894,039, filed on Mar. 9, 2007, provisional application No. 60/939,852, filed on May 24, 2007, provisional application No. 60/849,100, filed on Oct. 2, 2006, provisional application No. 60/850,885, filed on Oct. 10, 2006.

(58) Field of Classification Search
CPC ..... B60W 2050/0067; B60W 2550/22; B60W 2550/402; B60W 2720/103; B60W 30/146; B60W 50/10
USPC ..... 701/19, 20, 29, 33, 52, 54, 123
See application file for complete search history.

(56) References Cited

U.S. PATENT DOCUMENTS 2,111,513 A 3/1938 Phinney
2,148,005 A 2/1939 Allen et al.
2,233,932 A 3/1941 Allen
2,289,857 A 7/1942 Allen
2,293,926 A 8/1942 Wallace
2,366,802 A 1/1945 Pflasterer
2,628,335 A 2/1953 Drake
2,783,369 A 2/1957 Weber
2,925,552 A 2/1960 Cowan et al.
3,016,464 A 1/1962 Bailey
3,137,756 A 6/1964 Gunther et al.
3,246,141 A 4/1966 Ehrlich
3,393,600 A 7/1968 Bess
3,508,496 A 4/1970 Larson
3,517,307 A 6/1970 Wallen, Jr. et al.
3,537,401 A 11/1970 Metzner
3,562,419 A 2/1971 Stewart et al.
3,575,596 A 4/1971 Schatzel
3,589,815 A 6/1971 Hosterman
3,594,912 A 7/1971 Sauterel
3,604,359 A 9/1971 Doorley et al.
3,633,010 A 1/1972 Svetlichny
3,696,243 A 10/1972 Risely
3,718,040 A 2/1973 Freeman et al.
3,794,833 A * 2/1974 Blazek ..... B61L 3/221 246/187 B
3,805,056 A 4/1974 Birkin
3,813,885 A 6/1974 Tabor
3,821,558 A 6/1974 Mansfield
3,821,932 A 7/1974 Theurer et al.
3,828,440 A 8/1974 Plasser et al.
3,850,390 A 11/1974 Geiger
3,864,039 A 2/1975 Wilmarth
3,870,952 A 3/1975 Sibley
3,875,865 A 4/1975 Plasser et al.
3,896,665 A 7/1975 Goel
3,924,461 A 12/1975 Stayer
3,937,068 A 2/1976 Joy
3,937,432 A 2/1976 Birkin
3,960,005 A 6/1976 Vezina
3,962,908 A 6/1976 Joy
3,974,991 A 8/1976 Geiger
3,987,989 A 10/1976 Geiger
3,995,560 A 12/1976 MacKintosh
4,003,019 A * 1/1977 Tronel ..... B60K 35/00 340/462
4,005,601 A 2/1977 Botello
4,022,408 A 5/1977 Staples
4,040,738 A 8/1977 Wagner
4,042,810 A * 8/1977 Mosher ..... G09B 9/04 105/61
4,044,594 A 8/1977 Owens et al.
4,062,419 A 12/1977 Kadota
4,069,590 A 1/1978 Effinger
4,075,632 A 2/1978 Baldwin et al.
4,100,795 A 7/1978 Panetti
4,117,463 A 9/1978 Norton
4,117,529 A 9/1978 Stark et al.
4,143,553 A 3/1979 Martens et al.
4,145,018 A 3/1979 Poggio et al.
4,155,176 A 5/1979 Goel et al.
4,159,088 A 6/1979 Cosley
4,165,648 A 8/1979 Pagano
4,173,073 A 11/1979 Fukazawa et al.
4,174,636 A 11/1979 Pagano
4,181,278 A 1/1980 Pascoe
4,181,430 A 1/1980 Shirota et al.
4,198,164 A 4/1980 Cantor
4,207,569 A 6/1980 Meyer
4,214,647 A 7/1980 Lutts
4,222,275 A 9/1980 Sholl et al.
4,229,978 A 10/1980 Sholl et al.
4,235,112 A 11/1980 Kaiser
4,241,403 A 12/1980 Schultz
4,259,018 A 3/1981 Poirier
4,262,209 A 4/1981 Berner
4,279,395 A * 7/1981 Boggio ..... B60L 15/20 246/182 R
4,288,855 A 9/1981 Panetti
4,306,694 A 12/1981 Kuhn
4,324,376 A 4/1982 Kuhn
4,355,582 A 10/1982 Germer
4,360,873 A 11/1982 Wilde et al.
4,361,202 A 11/1982 Minovitch
4,383,448 A 5/1983 Fujimoto et al.
4,389,033 A 6/1983 Hardman
4,391,134 A 7/1983 Theurer et al.
4,417,466 A 11/1983 Panetti
4,417,522 A 11/1983 Theurer et al.
4,425,097 A 1/1984 Owens
4,429,576 A 2/1984 Norris
4,430,615 A 2/1984 Calvert
4,457,178 A 7/1984 Turbe et al.
4,467,430 A 8/1984 Even et al.
4,468,966 A 9/1984 Bradshaw
4,487,071 A 12/1984 Pagano et al.
4,490,038 A 12/1984 Theurer et al.
4,524,745 A 6/1985 Tominari et al.
4,531,837 A 7/1985 Panetti
4,538,061 A 8/1985 Jaquet
4,541,182 A 9/1985 Panetti
4,548,070 A 10/1985 Panetti
4,561,057 A * 12/1985 Haley, Jr. ..... B60L 3/12 360/6
4,565,548 A 1/1986 Davis et al.
4,577,494 A 3/1986 Jaeggi
4,578,665 A 3/1986 Yang
4,582,280 A 4/1986 Nichols et al.
4,582,580 A 4/1986 Goudal et al.
4,593,569 A 6/1986 Joy
4,602,335 A * 7/1986 Perlmutter ..... B60L 15/22 105/61
4,609,870 A 9/1986 Lale et al.
4,615,218 A 10/1986 Pagano
4,625,412 A 12/1986 Bradshaw
4,654,973 A 4/1987 Worthy
4,655,142 A 4/1987 Theurer et al.
4,662,224 A 5/1987 Turbe
4,689,995 A 9/1987 Turbe
4,691,565 A 9/1987 Theurer
4,700,223 A 10/1987 Shoutaro et al.
4,700,574 A 10/1987 Turbe
4,718,351 A * 1/1988 Engle ..... B61D 3/184 105/199.3
4,723,738 A 2/1988 Franke
4,728,063 A 3/1988 Petit et al.
4,735,384 A 4/1988 Elliott
4,741,207 A 5/1988 Spangler
4,763,526 A 8/1988 Pagano
4,773,590 A 9/1988 Dash et al.
4,886,226 A 12/1989 Frielinghaus

(56) References Cited

U.S. PATENT DOCUMENTS 4,915,504 A 4/1990 Thurston
4,932,614 A 6/1990 Birkin
4,932,618 A 6/1990 Davenport et al.
4,944,474 A * 7/1990 Jones ..... B61L 25/021 246/122 R
4,979,392 A 12/1990 Guinon
4,986,498 A 1/1991 Ratter et al.
5,009,014 A 4/1991 Leach
5,036,594 A 8/1991 Kesler et al.
5,055,835 A 10/1991 Sutton
5,086,591 A 2/1992 Panetti
5,094,004 A 3/1992 Wooten
5,101,358 A 3/1992 Panetti
5,129,605 A 7/1992 Burns et al.
5,133,645 A 7/1992 Crowley et al.
5,134,808 A 8/1992 Panetti
5,140,776 A 8/1992 Isdahl et al.
5,161,891 A 11/1992 Austill
5,177,684 A 1/1993 Harker et al.
5,197,438 A 3/1993 Kumano et al.
5,199,176 A 4/1993 Theurer et al.
5,201,294 A 4/1993 Osuka
5,203,089 A 4/1993 Trefouel et al.
5,230,613 A 7/1993 Hilsbos et al.
5,253,830 A 10/1993 Nayer et al.
5,261,366 A 11/1993 Regueiro
5,275,051 A 1/1994 De Beer
5,277,156 A 1/1994 Osuka et al.
5,301,548 A 4/1994 Theurer
5,313,924 A 5/1994 Regueiro
5,339,692 A 8/1994 Shoenhair et al.
5,341,683 A 8/1994 Searle
5,353,512 A 10/1994 Theurer et al.
5,357,912 A 10/1994 Barnes et al.
5,365,902 A 11/1994 Hsu
5,386,727 A 2/1995 Searle
5,394,851 A 3/1995 Cryer et al.
5,398,186 A 3/1995 Nakhla
5,419,196 A 5/1995 Havira et al.
5,420,883 A 5/1995 Swensen et al.
5,429,329 A 7/1995 Wallace et al.
5,433,111 A 7/1995 Hershey et al.
5,433,182 A 7/1995 Augustin et al.
5,441,027 A 8/1995 Buchanon et al.
5,452,222 A 9/1995 Gray et al.
5,459,663 A 10/1995 Franke
5,459,666 A 10/1995 Casper et al.
5,462,244 A 10/1995 Van Der Hoek et al.
5,475,597 A 12/1995 Buck
5,487,002 A 1/1996 Diller et al.
5,492,099 A 2/1996 Maddock
5,522,265 A 6/1996 Jaeggi
5,529,267 A 6/1996 Giras et al.
5,533,695 A 7/1996 Heggestad et al.
5,565,874 A 10/1996 Rode
5,570,284 A 10/1996 Roselli et al.
5,574,224 A 11/1996 Jaeggi
5,574,649 A 11/1996 Levy
5,574,659 A 11/1996 Delvers et al.
5,578,758 A 11/1996 Havira et al.
5,579,013 A 11/1996 Hershey et al.
5,588,716 A 12/1996 Stumpe
5,598,782 A 2/1997 Wiseman et al.
5,600,558 A 2/1997 Mearek et al.
5,605,099 A 2/1997 Sroka et al.
5,605,134 A 2/1997 Martin
5,613,442 A 3/1997 Ahola et al.
5,618,179 A 4/1997 Copperman et al.
5,623,244 A 4/1997 Cooper
5,627,508 A 5/1997 Cooper et al.
5,628,479 A 5/1997 Ballinger
5,636,026 A 6/1997 Mian et al.
RE35,590 E 8/1997 Bezos et al.
5,680,054 A 10/1997 Gauthier
5,681,015 A 10/1997 Kull
5,698,977 A 12/1997 Simpson et al.
5,699,986 A 12/1997 Welk
5,713,540 A 2/1998 Gerszberg et al.
5,719,771 A 2/1998 Buck et al.
5,720,455 A 2/1998 Kull et al.
5,721,685 A 2/1998 Holland et al.
5,735,492 A 4/1998 Pace
5,738,311 A 4/1998 Fernandez
5,740,547 A 4/1998 Kull et al.
5,743,495 A 4/1998 Welles, II et al.
5,751,144 A 5/1998 Weischedel
5,756,903 A 5/1998 Norby et al.
5,769,364 A 6/1998 Cipollone
5,775,228 A 7/1998 Lamba et al.
5,777,891 A 7/1998 Pagano et al.
5,786,535 A 7/1998 Takeuchi et al.
5,786,750 A 7/1998 Cooper
5,791,063 A 8/1998 Kesler et al.
5,804,731 A 9/1998 Jaeggi
5,813,635 A 9/1998 Fernandez
5,817,934 A 10/1998 Skantar
5,820,226 A 10/1998 Hart
5,832,895 A 11/1998 Takahashi et al.
5,833,325 A 11/1998 Hart
5,836,529 A 11/1998 Gibbs
5,856,802 A 1/1999 Ura et al.
5,867,404 A 2/1999 Bryan
5,913,170 A 6/1999 Northam
5,924,654 A 7/1999 Anderson
5,927,822 A 7/1999 Hart
5,928,294 A 7/1999 Zelinkovsky
5,934,764 A 8/1999 Dimsa et al.
5,936,517 A 8/1999 Yeh
5,944,392 A 8/1999 Tachihata et al.
5,950,966 A 9/1999 Hungate et al.
5,956,664 A 9/1999 Bryan
5,969,643 A 10/1999 Curtis
5,970,438 A 10/1999 Clark et al.
5,978,718 A 11/1999 Kull
5,983,144 A 11/1999 Bonissone et al.
5,986,547 A 11/1999 Korver et al.
5,986,577 A 11/1999 Bezos
5,986,579 A 11/1999 Halvorson
5,987,979 A 11/1999 Bryan
5,992,241 A 11/1999 Posgay et al.
5,995,737 A 11/1999 Bonissone et al.
5,995,881 A 11/1999 Kull
6,005,494 A 12/1999 Schramm
6,016,791 A 1/2000 Thomas et al.
6,026,687 A 2/2000 Jury
6,055,862 A 5/2000 Martens
6,064,428 A 5/2000 Trosino et al.
6,067,496 A 5/2000 Benoliel et al.
6,067,964 A 5/2000 Ruoff et al.
6,081,769 A 6/2000 Curtis
6,088,635 A 7/2000 Cox et al.
6,102,009 A 8/2000 Nishiyama
6,102,340 A 8/2000 Peek et al.
6,114,901 A 9/2000 Singh et al.
6,114,974 A 9/2000 Halvorson
6,119,353 A 9/2000 Gronskov
6,121,924 A 9/2000 Meek et al.
6,128,558 A 10/2000 Kemwein
6,158,416 A 12/2000 Chen et al.
6,158,822 A * 12/2000 Shirai ..... B60T 13/741 188/1.11 L
6,163,089 A 12/2000 Kull
6,163,755 A 12/2000 Peer et al.
6,179,252 B1 1/2001 Roop et al.
6,192,863 B1 2/2001 Takase
6,195,020 B1 2/2001 Brodeur, Sr. et al.
6,216,095 B1 4/2001 Glista
6,219,595 B1 4/2001 Nickles et al.
6,225,919 B1 5/2001 Lumbis et al.
6,262,573 B1 7/2001 Wojnarowski et al.
6,263,265 B1 7/2001 Fera
6,275,165 B1 8/2001 Bezos
6,286,480 B1 9/2001 Chen et al.
6,295,816 B1 10/2001 Gallagher et al.

(56) References Cited

U.S. PATENT DOCUMENTS 6,304,801 B1 10/2001 Doner
6,317,686 B1 11/2001 Ran
6,322,025 B1 11/2001 Colbert et al.
6,324,912 B1 12/2001 Wooh
6,347,265 B1 2/2002 Bidaud
6,349,653 B1 2/2002 Siedlarczyk
6,349,702 B1 2/2002 Nishiyama
6,349,706 B1 2/2002 Hsu et al.
6,357,421 B1 3/2002 Pritchard
6,360,998 B1 3/2002 Halvorson et al.
6,377,215 B1 4/2002 Halvorson et al.
6,405,141 B1 6/2002 Carr et al.
6,415,522 B1 7/2002 Ganz
6,416,020 B1 7/2002 Gronskov
6,417,765 B1 7/2002 Capanna
6,421,606 B1 7/2002 Asai et al.
6,427,114 B1 7/2002 Olsson
6,441,570 B1 8/2002 Grubba et al.
6,443,123 B1 9/2002 Aoki et al.
6,459,965 B1 10/2002 Polivka et al.
6,484,074 B1 11/2002 Hazard et al.
6,487,478 B1 11/2002 Azzaro et al.
6,490,523 B2 12/2002 Doner
6,493,627 B1 12/2002 Gallagher et al.
6,499,339 B1 12/2002 Hedstrom
6,499,815 B1 12/2002 Daigle
6,515,249 B1 2/2003 Valley et al.
6,516,668 B2 2/2003 Havira et al.
6,522,958 B1 2/2003 Dwyer et al.
6,523,787 B2 2/2003 Braband
6,525,658 B2 2/2003 Steelman et al.
6,533,223 B1 3/2003 Ireland
6,549,005 B1 4/2003 Hay et al.
6,553,838 B2 4/2003 Amini
6,556,945 B1 4/2003 Burggraf et al.
6,557,526 B1 5/2003 Hoshino
6,564,172 B1 5/2003 Till
6,570,497 B2 5/2003 Puckette, IV et al.
6,571,636 B1 6/2003 McWhorter
6,584,953 B2 7/2003 Yomogida
6,585,085 B1 7/2003 Kumar
6,588,114 B1 7/2003 Daigle
6,591,263 B1 7/2003 Becker et al.
6,604,421 B1 8/2003 Li
6,615,188 B1 9/2003 Breen et al.
6,631,322 B1 * 10/2003 Arthur ..... B61L 27/0027 340/991
6,634,112 B2 10/2003 Carr et al.
6,647,891 B2 11/2003 Holmes et al.
6,681,160 B2 1/2004 Bidaud
6,691,022 B2 2/2004 Takemura et al.
6,701,064 B1 3/2004 De Haan et al.
6,712,045 B1 3/2004 McCarthy, Jr.
6,725,782 B1 4/2004 Bloom et al.
6,728,515 B1 4/2004 Wooh
6,728,606 B2 4/2004 Kumar
6,728,625 B2 4/2004 Strubhar et al.
6,732,023 B2 * 5/2004 Sugita ..... B61L 27/0038 246/2 R
6,732,032 B1 5/2004 Banet et al.
6,742,392 B2 6/2004 Gilmore et al.
6,748,303 B2 * 6/2004 Hawthorne ..... B61L 27/0094 246/169 R
6,748,313 B2 6/2004 Li et al.
6,778,284 B2 8/2004 Casagrande
6,782,044 B1 8/2004 Wright et al.
6,804,621 B1 10/2004 Pedanckar
6,812,888 B2 11/2004 Drury et al.
6,814,050 B2 11/2004 Kishibata et al.
6,814,060 B1 11/2004 Solomons et al.
6,823,844 B2 11/2004 Steinbrenner et al.
6,833,554 B2 12/2004 Wooh
6,853,890 B1 2/2005 Horst et al.
6,854,691 B2 2/2005 Kraeling et al.
6,873,888 B2 * 3/2005 Kumar ..... B60L 9/00 701/19
6,893,262 B2 5/2005 Stockman
6,895,362 B2 5/2005 Davenport et al.
6,904,110 B2 6/2005 Trans et al.
6,945,114 B2 9/2005 Kenderian et al.
6,947,830 B1 9/2005 Froloff et al.
6,951,132 B2 10/2005 Davenport et al.
6,976,324 B2 12/2005 Theurer et al.
7,007,561 B1 3/2006 Otto et al.
7,023,539 B2 4/2006 Kowalski
7,031,823 B2 4/2006 Chatfield et al.
7,036,232 B2 5/2006 Casagrande
7,047,130 B2 5/2006 Watanabe et al.
7,050,926 B2 5/2006 Theurer et al.
7,051,693 B2 5/2006 Tetsuno et al.
7,053,606 B2 5/2006 Buttle et al.
7,054,762 B2 5/2006 Pagano et al.
7,072,747 B2 * 7/2006 Armbruster ..... B61L 3/006 246/122 R
7,079,926 B2 * 7/2006 Kane ..... B61L 3/008 246/14
7,081,824 B2 7/2006 Gilbert
7,082,881 B2 8/2006 Schneider et al.
7,082,924 B1 8/2006 Ruedin
7,140,477 B2 11/2006 Engle et al.
7,152,330 B2 12/2006 Kleeberg
7,161,500 B2 1/2007 Alfredsson et al.
7,181,851 B2 2/2007 Theurer et al.
7,188,009 B2 3/2007 Hawthorne
7,197,932 B2 4/2007 Sakai et al.
7,200,536 B2 4/2007 Wynn
7,201,350 B2 4/2007 Sugita et al.
7,219,067 B1 * 5/2007 McMullen ..... B61L 27/0011 246/122 R
7,226,021 B1 6/2007 Anderson et al.
7,228,747 B2 6/2007 Pieper
7,234,449 B2 6/2007 Casabianca et al.
7,263,647 B2 8/2007 Bryant et al.
7,263,886 B2 9/2007 Jury
7,290,807 B2 11/2007 Kumar
7,296,770 B2 11/2007 Franke
7,302,895 B2 * 12/2007 Kumar ..... B60L 15/32 105/26.05
7,305,885 B2 12/2007 Barshinger et al.
7,309,929 B2 12/2007 Donnelly et al.
7,312,607 B2 12/2007 Nygaard
7,337,766 B2 3/2008 Nakayama et al.
7,387,029 B2 6/2008 Cunningham
7,389,694 B1 6/2008 Hay et al.
7,392,117 B1 6/2008 Bilodeau et al.
7,394,553 B2 7/2008 Carr et al.
7,395,141 B1 7/2008 Seck et al.
7,403,296 B2 7/2008 Farritor et al.
7,416,262 B2 8/2008 Ring
7,463,348 B2 12/2008 Chung
7,500,436 B2 * 3/2009 Kumar ..... B60L 11/123 105/26.05
7,502,670 B2 3/2009 Harrison
7,520,415 B2 4/2009 Kral et al.
7,522,990 B2 * 4/2009 Daum ..... B60L 15/36 701/123
7,523,893 B2 4/2009 Francis et al.
7,539,596 B2 5/2009 Zoll et al.
7,543,670 B2 6/2009 Tamai et al.
7,557,748 B1 7/2009 Zahm et al.
7,565,867 B2 7/2009 Donnelly et al.
7,575,201 B2 8/2009 Bartonek
7,659,972 B2 2/2010 Magnus et al.
7,716,010 B2 5/2010 Pelletier
7,734,387 B1 6/2010 Young et al.
7,752,913 B2 7/2010 Heckel et al.
7,755,660 B2 7/2010 Nejikovsky et al.
7,770,847 B1 8/2010 Severson
7,778,747 B2 8/2010 Hawkins et al.
7,783,397 B2 8/2010 Peitz et al.
7,811,089 B2 10/2010 Bond
7,869,909 B2 1/2011 Harrison
7,872,736 B2 1/2011 Rogers et al.

(56) References Cited

U.S. PATENT DOCUMENTS 7,882,742 B1 2/2011 Martens
7,895,135 B2 2/2011 Norris et al.
7,920,984 B2 4/2011 Farritor
7,937,246 B2 5/2011 Farritor et al.
7,938,370 B1 5/2011 Lechevin et al.
7,940,389 B2 5/2011 Rogers et al.
8,020,446 B2 9/2011 Bestebreurtje
8,030,871 B1 10/2011 Young et al.
8,037,763 B2 10/2011 Brignac et al.
8,068,975 B2 11/2011 Jensen et al.
8,081,320 B2 12/2011 Villar et al.
8,125,219 B2 2/2012 Jungbluth et al.
8,126,601 B2 2/2012 Kapp et al.
8,150,568 B1 4/2012 Gray
8,154,227 B1 4/2012 Young et al.
8,155,811 B2 4/2012 Noffsinger et al.
8,157,218 B2 4/2012 Riley et al.
8,157,219 B2 4/2012 Ashraf et al.
8,160,832 B2 4/2012 Luo et al.
8,195,364 B2 6/2012 Norris et al.
8,264,330 B2 9/2012 Yeldell et al.
8,266,092 B2 9/2012 Kuhn et al.
8,305,567 B2 11/2012 Hesser et al.
8,428,798 B2 4/2013 Kull
8,521,345 B2 8/2013 Cooper et al.
8,532,842 B2 9/2013 Smith et al.
8,626,366 B2 1/2014 Noffsinger et al.
8,645,047 B2 2/2014 Daum et al.
8,655,518 B2 2/2014 Cooper et al.
8,655,519 B2 2/2014 Cooper et al.
8,682,514 B2 3/2014 Falk et al.
9,108,640 B2 8/2015 Jackson
2001/0001131 A1 5/2001 Miller
2001/0019263 A1 9/2001 Kwun et al.
2001/0026321 A1 10/2001 Goto
2001/0045495 A1 11/2001 Olson et al.
2002/0010531 A1 1/2002 Hawthorne et al.
2002/0062819 A1 5/2002 Takahashi
2002/0065698 A1 5/2002 Schick et al.
2002/0104779 A1 8/2002 Connor et al.
2002/0113170 A1 8/2002 Grappone
2002/0148931 A1 10/2002 Anderson
2002/0157901 A1 10/2002 Kast et al.
2002/0195086 A1 12/2002 Beck et al.
2003/0000499 A1 1/2003 Doelker et al.
2003/0010872 A1 1/2003 Lewin et al.
2003/0020469 A1 1/2003 Katragadda et al.
2003/0038216 A1 2/2003 Holgate
2003/0055666 A1 3/2003 Roddy et al.
2003/0060968 A1 3/2003 MacPhail et al.
2003/0070492 A1 4/2003 Buttle et al.
2003/0076221 A1* 4/2003 Akiyama ..... H04L 12/40182 340/12.32
2003/0107548 A1 6/2003 Eun et al.
2003/0120400 A1* 6/2003 Ahmed Baig ..... B60L 15/32 701/19
2003/0128030 A1 7/2003 Hintze et al.
2003/0139909 A1 7/2003 Ozawa
2003/0187694 A1 10/2003 Rowen
2003/0214417 A1 11/2003 Peltz et al.
2003/0229097 A1 12/2003 Watkins et al.
2003/0233959 A1* 12/2003 Kumar ..... B60L 7/06 105/26.05
2004/0024515 A1* 2/2004 Troupe ..... B60K 28/10 701/93
2004/0024518 A1 2/2004 Boley et al.
2004/0025849 A1 2/2004 West et al.
2004/0026574 A1 2/2004 Seifert
2004/0038831 A1 2/2004 Eadie
2004/0048620 A1 3/2004 Nakahara et al.
2004/0049339 A1 3/2004 Kober et al.
2004/0073361 A1 4/2004 Tzamaloukas et al.
2004/0075280 A1 4/2004 Kumar et al.
2004/0095135 A1 5/2004 Nejikovsky et al.
2004/0107042 A1 6/2004 Seick
2004/0143374 A1 7/2004 Horst et al.
2004/0153221 A1* 8/2004 Kumar ..... B60L 9/00 701/19
2004/0167687 A1 8/2004 Komick et al.
2004/0238693 A1 12/2004 Cole
2004/0243664 A1* 12/2004 Horstemeyer ..... B60R 25/102 709/200
2004/0249571 A1 12/2004 Blesener et al.
2005/0004723 A1 1/2005 Duggan et al.
2005/0045058 A1 3/2005 Donnelly et al.
2005/0055157 A1 3/2005 Scholl
2005/0065711 A1 3/2005 Dahlgren et al.
2005/0076716 A1 4/2005 Turner
2005/0090978 A1 4/2005 Bathory et al.
2005/0096797 A1 5/2005 Matsubara et al.
2005/0099323 A1 5/2005 Hirose
2005/0109882 A1* 5/2005 Armbruster ..... B61L 3/006 246/167 R
2005/0120904 A1* 6/2005 Kumar ..... B60L 15/32 105/35
2005/0121971 A1 6/2005 Ring
2005/0171657 A1* 8/2005 Kumar ..... B60L 9/00 701/19
2005/0186325 A1 8/2005 Luangthep
2005/0189815 A1 9/2005 Bryant
2005/0189886 A1 9/2005 Donnelly et al.
2005/0192720 A1 9/2005 Christie et al.
2005/0210304 A1 9/2005 Hartung et al.
2005/0229604 A1 10/2005 Chen
2005/0253397 A1 11/2005 Kumar et al.
2005/0285552 A1 12/2005 Grubba et al.
2006/0005736 A1 1/2006 Kumar
2006/0017911 A1 1/2006 Villar et al.
2006/0025903 A1 2/2006 Kumar
2006/0030978 A1 2/2006 Rajaram
2006/0055175 A1 3/2006 Grinblat
2006/0076461 A1 4/2006 Derose et al.
2006/0086546 A1 4/2006 Hu et al.
2006/0098843 A1 5/2006 Chew
2006/0129289 A1* 6/2006 Kumar ..... B60L 11/123 105/26.05
2006/0178800 A1 8/2006 Chen et al.
2006/0187086 A1 8/2006 Quintos
2006/0212189 A1 9/2006 Kickbusch et al.
2006/0219214 A1 10/2006 Okude et al.
2006/0225710 A1 10/2006 Taglialatela et al.
2006/0231066 A1 10/2006 Demura et al.
2006/0235584 A1 10/2006 Fregene et al.
2006/0235604 A1 10/2006 Taglialatela et al.
2006/0253233 A1 11/2006 Metzger
2006/0271291 A1 11/2006 Meyer
2006/0282199 A1* 12/2006 Daum ..... B60L 15/36 701/19
2007/0006831 A1 1/2007 Leone et al.
2007/0062476 A1 3/2007 Ota et al.
2007/0073466 A1 3/2007 Tamai et al.
2007/0093148 A1 4/2007 Gibbs et al.
2007/0108308 A1 5/2007 Keightley
2007/0129852 A1 6/2007 Chen et al.
2007/0132463 A1 6/2007 Anderson
2007/0135988 A1 6/2007 Kidston et al.
2007/0163352 A1 7/2007 Nielsen et al.
2007/0183039 A1 8/2007 Irvin
2007/0209619 A1 9/2007 Leone
2007/0217670 A1 9/2007 Bar-Am
2007/0219681 A1 9/2007 Kumar et al.
2007/0219682 A1 9/2007 Kumar et al.
2007/0225878 A1 9/2007 Kumar et al.
2007/0233335 A1 10/2007 Kumar et al.
2007/0241237 A1 10/2007 Foy et al.
2007/0250225 A1 10/2007 Nickles et al.
2007/0250255 A1 10/2007 Matekunas et al.
2007/0260367 A1 11/2007 Wills et al.
2007/0274158 A1 11/2007 Agam et al.
2008/0010571 A1 1/2008 Farnsworth et al.
2008/0041267 A1 2/2008 Denen et al.
2008/0065282 A1 3/2008 Daum et al.
2008/0091334 A1 4/2008 Carlson et al.
2008/0109124 A1 5/2008 Daum et al.

(56) References Cited

U.S. PATENT DOCUMENTS

| | | | | |
|---|---|---|---|---|
| 2008/0110249 | A1 | 5/2008 | Degeorge et al. | |
| 2008/0125924 | A1 | 5/2008 | Daum et al. | |
| 2008/0128563 | A1* | 6/2008 | Kumar | B61L 3/127 246/187 A |
| 2008/0142645 | A1 | 6/2008 | Tomlinson et al. | |
| 2008/0161984 | A1 | 7/2008 | Hrdlicka et al. | |
| 2008/0164078 | A1 | 7/2008 | Rhodes et al. | |
| 2008/0183345 | A1 | 7/2008 | Chandra et al. | |
| 2008/0183490 | A1 | 7/2008 | Martin et al. | |
| 2008/0201019 | A1 | 8/2008 | Kumar et al. | |
| 2008/0201056 | A1 | 8/2008 | Moriya | |
| 2008/0201089 | A1 | 8/2008 | Diaz et al. | |
| 2008/0296441 | A1 | 12/2008 | Anderson et al. | |
| 2008/0312775 | A1 | 12/2008 | Kumar | |
| 2009/0044530 | A1 | 2/2009 | Gallagher et al. | |
| 2009/0076664 | A1 | 3/2009 | McCabe et al. | |
| 2009/0078236 | A1 | 3/2009 | Gallagher et al. | |
| 2009/0132179 | A1 | 5/2009 | Fu et al. | |
| 2009/0159046 | A1 | 6/2009 | Moriya | |
| 2009/0164104 | A1 | 6/2009 | Wermuth et al. | |
| 2009/0186325 | A1 | 7/2009 | Kumar | |
| 2009/0187291 | A1 | 7/2009 | Daum et al. | |
| 2009/0193899 | A1 | 8/2009 | Panetta et al. | |
| 2009/0198391 | A1 | 8/2009 | Kumar | |
| 2009/0205028 | A1 | 8/2009 | Smeets et al. | |
| 2009/0241909 | A1 | 10/2009 | Smith | |
| 2009/0248220 | A1 | 10/2009 | Ecton et al. | |
| 2009/0266166 | A1 | 10/2009 | Pagano | |
| 2009/0266943 | A1 | 10/2009 | Kumar et al. | |
| 2009/0282923 | A1 | 11/2009 | Havira | |
| 2009/0299555 | A1 | 12/2009 | Houpt et al. | |
| 2010/0023190 | A1 | 1/2010 | Kumar et al. | |
| 2010/0023240 | A1 | 1/2010 | Haskara et al. | |
| 2010/0049384 | A1 | 2/2010 | Kraeling et al. | |
| 2010/0049408 | A1 | 2/2010 | Abadie et al. | |
| 2010/0084916 | A1 | 4/2010 | Kumar et al. | |
| 2010/0114404 | A1 | 5/2010 | Donnelly | |
| 2010/0130124 | A1 | 5/2010 | Teeter et al. | |
| 2010/0131130 | A1 | 5/2010 | Kalyanam et al. | |
| 2010/0174427 | A1 | 7/2010 | Sivasubramaniam et al. | |
| 2010/0207620 | A1 | 8/2010 | Gies | |
| 2010/0235022 | A1 | 9/2010 | Siddappa et al. | |
| 2010/0262321 | A1 | 10/2010 | Daum et al. | |
| 2010/0312493 | A1 | 12/2010 | Purekar et al. | |
| 2010/0318247 | A1 | 12/2010 | Kumar | |
| 2010/0332058 | A1 | 12/2010 | Kane et al. | |
| 2011/0006167 | A1 | 1/2011 | Tolmei | |
| 2011/0029243 | A1 | 2/2011 | Gallagher et al. | |
| 2011/0035138 | A1 | 2/2011 | Kickbusch et al. | |
| 2011/0060486 | A1 | 3/2011 | Meltser et al. | |
| 2011/0093144 | A1 | 4/2011 | Goodermuth et al. | |
| 2011/0118899 | A1 | 5/2011 | Brooks et al. | |
| 2011/0199607 | A1 | 8/2011 | Kanellopoulos et al. | |
| 2011/0216996 | A1 | 9/2011 | Rogers | |
| 2011/0233293 | A1 | 9/2011 | Kral et al. | |
| 2011/0255077 | A1 | 10/2011 | Rogers | |
| 2011/0257869 | A1 | 10/2011 | Kumar et al. | |
| 2011/0276203 | A1 | 11/2011 | Hase | |
| 2011/0284700 | A1 | 11/2011 | Brand et al. | |
| 2011/0307113 | A1 | 12/2011 | Kumar et al. | |
| 2012/0022728 | A1 | 1/2012 | Hall et al. | |
| 2012/0108204 | A1 | 5/2012 | Schell et al. | |
| 2012/0108205 | A1 | 5/2012 | Schell et al. | |
| 2012/0108207 | A1 | 5/2012 | Schell et al. | |
| 2012/0135710 | A1 | 5/2012 | Schell et al. | |
| 2012/0197504 | A1 | 8/2012 | Sujan et al. | |
| 2012/0217351 | A1 | 8/2012 | Chadwick et al. | |
| 2012/0245766 | A1 | 9/2012 | Cooper et al. | |
| 2012/0245770 | A1 | 9/2012 | Yamamoto et al. | |
| 2012/0259531 | A1 | 10/2012 | Daum et al. | |
| 2012/0277940 | A1 | 11/2012 | Kumar et al. | |
| 2012/0290185 | A1 | 11/2012 | Cooper et al. | |
| 2012/0296545 | A1 | 11/2012 | Cooper et al. | |
| 2012/0310453 | A1* | 12/2012 | Brooks | B61L 3/006 701/20 |
| 2012/0316717 | A1 | 12/2012 | Daum et al. | |
| 2013/0015298 | A1 | 1/2013 | Cooper et al. | |
| 2013/0035811 | A1 | 2/2013 | Schroeck et al. | |
| 2013/0062474 | A1 | 3/2013 | Baldwin et al. | |
| 2013/0131898 | A1 | 5/2013 | Kumar et al. | |
| 2013/0131909 | A1 | 5/2013 | Cooper et al. | |
| 2013/0169037 | A1 | 7/2013 | Bieg et al. | |
| 2013/0171590 | A1 | 7/2013 | Kumar | |
| 2013/0173083 | A1 | 7/2013 | Cooper et al. | |
| 2013/0261837 | A1 | 10/2013 | Sharma et al. | |
| 2013/0261856 | A1 | 10/2013 | Sharma et al. | |
| 2013/0284859 | A1 | 10/2013 | Polivka et al. | |
| 2013/0334373 | A1 | 12/2013 | Malone, Jr. et al. | |
| 2014/0094998 | A1 | 4/2014 | Cooper et al. | |
| 2014/0125356 | A1 | 5/2014 | Cooper et al. | |
| 2014/0129154 | A1 | 5/2014 | Cooper et al. | |
| 2014/0138493 | A1 | 5/2014 | Noffsinger et al. | |
| 2014/0156123 | A1 | 6/2014 | Cooper et al. | |
| 2014/0277824 | A1 | 9/2014 | Kemwein et al. | |
| 2014/0280899 | A1 | 9/2014 | Brewster, Jr. et al. | |
| 2015/0009331 | A1 | 1/2015 | Venkatraman | |
| 2015/0053827 | A1 | 2/2015 | Noffsinger et al. | |
| 2015/0183448 | A1 | 7/2015 | Cooper et al. | |

FOREIGN PATENT DOCUMENTS

| | | | |
|---|---|---|---|
| CA | 1065039 | A | 10/1979 |
| CA | 2466540 | A1 | 11/2004 |
| CA | 2627074 | A1 | 5/2007 |
| CH | 642418 | A5 | 4/1984 |
| CN | 1511744 | A | 7/2004 |
| CN | 1636814 | A | 7/2005 |
| CN | 1683914 | A | 10/2005 |
| CN | 1819942 | A | 8/2006 |
| CN | 1906074 | A | 1/2007 |
| CN | 1958363 | A | 5/2007 |
| CN | 101351373 | A | 1/2009 |
| CN | 101412377 | A | 4/2009 |
| CN | 102556118 | B | 6/2014 |
| DE | 3538165 | A1 | 4/1987 |
| DE | 4225800 | C1 | 11/1993 |
| DE | 19654960 | A1 | 7/1998 |
| DE | 19731643 | A1 | 9/1998 |
| DE | 19830053 | C1 | 11/1999 |
| DE | 19826764 | A1 | 12/1999 |
| DE | 10226143 | B4 | 2/2006 |
| DE | 102005051077 | A1 | 4/2007 |
| DE | 202010006811 | U1 | 7/2010 |
| DE | 102010026433 | A1 | 1/2012 |
| DE | 102010045234 | A1 | 3/2012 |
| EP | 88716 | A2 | 9/1983 |
| EP | 644098 | A2 | 3/1995 |
| EP | 719690 | A2 | 7/1996 |
| EP | 1034984 | A2 | 9/2000 |
| EP | 1143140 | A1 | 10/2001 |
| EP | 1293948 | A2 | 3/2003 |
| EP | 1348854 | A1 | 10/2003 |
| EP | 1562321 | A2 | 8/2005 |
| EP | 1566533 | A1 | 8/2005 |
| EP | 1754644 | A1 | 2/2007 |
| GB | 2371121 | A | 7/2002 |
| JP | 52121192 | A | 10/1977 |
| JP | 63268405 | A | 11/1988 |
| JP | 11002558 | A | 4/1989 |
| JP | 561347 | A | 3/1993 |
| JP | 5238392 | A | 9/1993 |
| JP | 5278615 | A | 10/1993 |
| JP | 7132832 | A | 5/1995 |
| JP | 9193804 | A | 7/1997 |
| JP | 9200910 | A | 7/1997 |
| JP | 10274075 | A | 10/1998 |
| JP | 2858529 | B2 | 2/1999 |
| JP | 2002204507 | A | 7/2002 |
| JP | 2002249049 | A | 9/2002 |
| JP | 2002294609 | A | 10/2002 |
| JP | 2003095109 | A | 4/2003 |
| JP | 2004301080 | A | 10/2004 |
| JP | 2004328993 | A | 11/2004 |
| JP | 2006219051 | A | 8/2006 |

(56) References Cited

FOREIGN PATENT DOCUMENTS

| | | | |
|---|---|---|---|
| JP | 2009095094 | A | 4/2009 |
| KZ | 386 | U | 8/2008 |
| NO | 2005028837 | A2 | 3/2005 |
| RU | 2115140 | C1 | 7/1998 |
| RU | 2207279 | C1 | 6/2003 |
| RU | 2213669 | C1 | 10/2003 |
| RU | 2233011 | C2 | 7/2004 |
| RU | 2237589 | C1 | 10/2004 |
| RU | 2238860 | C1 | 10/2004 |
| RU | 2238869 | C1 | 10/2004 |
| RU | 2242392 | C2 | 12/2004 |
| RU | 2265539 | C2 | 12/2005 |
| RU | 2272731 | C2 | 3/2006 |
| RU | 2273567 | C1 | 4/2006 |
| RU | 2286279 | C2 | 10/2006 |
| RU | 2299144 | C2 | 5/2007 |
| RU | 2320498 | C1 | 3/2008 |
| RU | 83221 | U1 | 5/2009 |
| SU | 568241 | A1 | 12/1981 |
| WO | 199601431 | A1 | 1/1996 |
| WO | 1998058829 | A1 | 12/1998 |
| WO | 1999060735 | A1 | 11/1999 |
| WO | 200009377 | A1 | 2/2000 |
| WO | 200186139 | A1 | 11/2001 |
| WO | 200230729 | A1 | 4/2002 |
| WO | 2002060738 | A1 | 8/2002 |
| WO | 2004039621 | A1 | 5/2004 |
| WO | 2006065730 | A2 | 6/2006 |
| WO | 2006133306 | A1 | 12/2006 |
| WO | 2007110613 | A1 | 10/2007 |
| WO | 2007116123 | A1 | 10/2007 |
| WO | 2008012535 | A2 | 1/2008 |
| WO | 2008065032 | A1 | 6/2008 |
| WO | 2008073547 | A2 | 6/2008 |
| WO | 2008099177 | A1 | 8/2008 |
| WO | 2009087385 | A2 | 7/2009 |
| WO | 2009092218 | A1 | 7/2009 |
| WO | 2010039680 | A1 | 4/2010 |
| WO | 2010139489 | A1 | 12/2010 |
| WO | 2011146088 | A1 | 11/2011 |
| WO | 2012041978 | A2 | 4/2012 |
| WO | 2014193610 | A1 | 12/2014 |
| ZA | 200101708 | B | 8/2001 |

OTHER PUBLICATIONS

Juli-Ann Luther et al., filed Sep. 19, 2014, U.S. Appl. No. 14/491,339.
William P. Martin et al., filed Apr. 2, 2008, U.S. Appl. No. 12/061,486.
Juli-Ann Luther et al., filed May 20, 2016, U.S. Appl. No. 15/160,541.
Kevin L. Kapp et al., filed Oct. 17, 2012, U.S. Appl. No. 13/653,440.
Wolfgang Daum et al., filed Oct. 2, 2006, U.S. Appl. No. 60/849,100.
Wolfgang Daum et al., filed Oct. 10, 2006, U.S. Appl. No. 60/850,885.
Wolfgang Daum et al., filed Jan. 31, 2007, U.S. Appl. No. 11/669,364.
Wolfgang Daum et al., filed Mar. 9, 2007, U.S. Appl. No. 60/894,039.
Wolfgang Daum et al., filed May 24, 2007, U.S. Appl. No. 60/939,852.
Wolfgang Daum et al., filed Jun. 19, 2007, U.S. Appl. No. 11/765,443.
Wolfgang Daum et al., filed Feb. 7, 2008, U.S. Appl. No. 12/027,408.
Wolfgang Daum et al., filed Mar. 20, 2008, U.S. Appl. No. 12/052,000.
Wolfgang Daum et al., filed Jun. 21, 2012, U.S. Appl. No. 13/529,783.
Ajith Kuttannair Kumar et al., filed Mar. 20, 2006, U.S. Appl. No. 11/385,354.
Ajith Kuttannair Kumar et al., filed Dec. 7, 2006, U.S. Appl. No. 11/608,066.
Ajith Kuttannair Kumar et al., filed Dec. 8, 2006, U.S. Appl. No. 11/608,257.
Ajith Kuttannair Kumar et al., filed Mar. 9, 2007, U.S. Appl. No. 60/894,006.
Ajith Kuttannair Kumar et al., filed May 18, 2007, U.S. Appl. No. 11/750,716.
Saravanan Thiyagarajan et al., filed Mar. 21, 2008, U.S. Appl. No. 12/052,816.
Kevin Kapp et al., filed Mar. 13, 2008, U.S. Appl. No. 12/047,427.
Ramu Sharat Chandra et al., filed Mar. 21, 2008, U.S. Appl. No. 12/052,790.
Ajith Kuttannair Kumar et al., filed Jul. 10, 2012, U.S. Appl. No. 13/545,271.
Ramu Sharat Chandra et al., filed Aug. 27, 2012, U.S. Appl. No. 13/595,474.
Kevin Kapp et al., filed Jan. 5, 2012, U.S. Appl. No. 13/344,331.
Ajith Kuttannair Kumar et al., filed Jan. 11, 2013, U.S. Appl. No. 13/739,133.
Ajith Kuttannair Kumar et al., filed Sep. 17, 2014, U.S. Appl. No. 14/489,126.
Ajith Kuttannair Kumar et al., filed Sep. 24, 2015, U.S. Appl. No. 14/863,998.
Jared Klineman Cooper et al., filed Mar. 4, 2015, U.S. Appl. No. 14/637,513.
Ajith Kuttannair Kumar et al., filed Mar. 9, 2007, U.S. Appl. No. 60/894,024.
Ajith Kuttannair Kumar et al., filed May 14, 2008, U.S. Appl. No. 12/045,633.
James D. Brooks et al., filed Mar. 21, 2008, U.S. Appl. No. 12/052,782.
Patricia Sue Lacy et al., filed Apr. 2, 2008, U.S. Appl. No. 12/061,444.
James D. Brooks et al., filed Apr. 2, 2008, U.S. Appl. No. 12/061,462.
James D. Brooks et al., filed Aug. 17, 2012, U.S. Appl. No. 13/587,966.
Ajith Kuttannair Kumar, filed May 23, 2007, U.S. Appl. No. 60/939,850.
Ajith Kuttannair Kumar, filed May 24, 2008, U.S. Appl. No. 12/126,858.
Ajith Kuttannair Kumar, filed Sep. 14, 2012, U.S. Appl. No. 13/618,970.
Ajith Kuttannair Kumar, filed Apr. 28, 2008, U.S. Appl. No. 61/048,344.
Ajith Kuttannair Kumar, filed May 28, 2008, U.S. Appl. No. 12/128,249.
Ajith Kuttannair Kumar, filed Feb. 27, 2013, U.S. Appl. No. 13/778,428.
Tom Otsubo et al., filed Nov. 15, 2007, U.S. Appl. No. 60/988,191.
James Andrew Napolitano et al., filed Aug. 12, 2014, U.S. Appl. No. 14/457,304.
Wolfgang Daum et al., filed Jun. 11, 2008, U.S. Appl. No. 61/060,785.
Wolfgang Daum et al., filed Feb. 4, 2009, U.S. Appl. No. 12/365,359.
Wolfgang Daum et al., filed Jun. 15, 2009, U.S. Appl. No. 12/484,278.
Jared Klineman Cooper et al., filed Dec. 3, 2013, U.S. Appl. No. 14/095,373.
Shawn Michael Gallagher et al., filed Sep. 20, 2007, U.S. Appl. No. 11/858,345.
Shawn Michael Gallagher et al., filed Oct. 26, 2009, U.S. Appl. No. 12/605,498.
Mikhali Melster et al., filed Sep. 9, 2009, U.S. Appl. No. 12/556,334.
Jared Cooper et al., filed Jul. 1, 2011, U.S. Appl. No. 13/175,284.
Patricia Sue Lacy et al., filed May 23, 2007, U.S. Appl. No. 60/939,848.

(56) References Cited

OTHER PUBLICATIONS

Patricia Sue Lacy et al., filed Jun. 7, 2007, U.S. Appl. No. 60/942,559.
Jared Klineman Cooper et al., filed Nov. 21, 2012, U.S. Appl. No. 61/729,188.
Jared Klineman Cooper, filed Jul. 30, 2013, U.S. Appl. No. 13/954,096.
Joseph Forrest Noffsinger et al., filed Sep. 3, 2013, U.S. Appl. No. 14/016,310.
Joseph Forrest Noffsinger et al., filed Oct. 29, 2014, U.S. Appl. No. 14/527,246.
Joseph Forrest Noffsinger et al., filed Mar. 19, 2016, U.S. Appl. No. 15/075,118.
Brett Alexander Matthews et al., filed May 21, 2015, U.S. Appl. No. 62/165,007.
Brett Alexander Matthews et al., filed Feb. 18, 2016, U.S. Appl. No. 15/047,083.
Joseph Forrest Noffsinger, filed Aug. 10, 2012, U.S. Appl. No. 61/681,843.
Joseph Forrest Noffsinger et al., filed Jul. 11, 2013, U.S. Appl. No. 13/939,326.
Jared Klineman Cooper et al., filed Jul. 31, 2013, U.S. Appl. No. 61/860,496.
Jared Klineman Cooper et al., filed Jan. 15, 2014, U.S. Appl. No. 14/155,454.
Jared Klineman Cooper et al., filed Jun. 5, 2012, U.S. Appl. No. 13/488,652.
Ajith Kumar et al., filed Jan. 6, 2003, U.S. Appl. No. 60/438,234.
Ajith K. Kumar et al., filed Dec. 15, 2003, U.S. Appl. No. 10/736,089.
Ajith Kuttannair Kumar et al., filed Aug. 22, 2012, U.S. Appl. No. 13/591,561.
Ajith Kuttannair Kumar et al., filed Dec. 8, 2006, U.S. Appl. No. 60/869,196.
Ajith Kuttannair Kumar et al., filed Jan. 11, 2007, U.S. Appl. No. 11/622,136.
Wolfgang Daum et al., filed May 19, 2006, U.S. Appl. No. 60/802,147.
Wolfgang Daum et al., filed Jan. 9, 2007, U.S. Appl. No. 11/621,221.
Ajith Kuttannair Kumar, filed Dec. 18, 2006, U.S. Appl. No. 60/870,562.
Ajith Kuttannair Kumar, filed Feb. 6, 2007, U.S. Appl. No. 11/671,533.
Ajith Kuttannair Kumar et al., filed Jun. 29, 2011, U.S. Appl. No. 13/171,712.
Ajith Kuttannair Kumar et al., filed Nov. 5, 2015, U.S. Appl. No. 14/933,659.
Wolfgang Daum et al., filed Oct. 2, 2006, U.S. Appl. No. 60/849,101.
Wolfgang Daum et al., filed May 23, 2007, U.S. Appl. No. 60/939,851.
Wolfgang Daum et al., filed Jul. 31, 2007, U.S. Appl. No. 11/831,492.
Ajith Kuttannair Kumar et al., filed Oct. 4, 2009, U.S. Appl. No. 12/573,141.
Sameh Fahmy, filed Mar. 17, 2015, U.S. Appl. No. 62/134,518.
Sameh Fahmy et al., filed Oct. 26, 2015, U.S. Appl. No. 14/922,787.
Sameh Fahmy, filed Feb. 16, 2016, U.S. Appl. No. 15/044,592.
Joseph Forrest Noffsinger et al., filed Jul. 31, 2013, U.S. Appl. No. 61/860,469.
Joseph Forrest Noffsinger et al., filed Mar. 21, 2014, U.S. Appl. No. 14/221,624.
Jared Klineman Cooper et al., filed Aug. 2, 2012, U.S. Appl. No. 13/565,571.
Jared Klineman Cooper, filed Mar. 15, 2013, U.S. Appl. No. 13/840,656.
Jared Klineman Cooper et al., filed Mar. 13, 2015, U.S. Appl. No. 14/657,233.
Joseph Forrest Noffsinger et al., filed Apr. 28, 2014, U.S. Appl. No. 61/985,103.
Joseph Forrest Noffsinger et al., filed Apr. 6, 2015, U.S. Appl. No. 14/679,217.
Yuri Alexeyevich Plotnikov et al., filed Aug. 31, 2015, U.S. Appl. No. 14/841,209.
Joseph Forrest Noffsinger et al., filed May 14, 2015, U.S. Appl. No. 62/161,626.
Joseph Forrest Noffsinger et al., filed May 6, 2016, U.S. Appl. No. 15/148,570.
Krevitt, "Remote Maintenance Techniques Proposed for the 200-BEV Accelerator", IEEE Transactions on Nuclear Science, vol. No. 14, Issue No. 3, pp. 997-1003, Jun. 1967.
Kiersztyn et al., "Evaluation of Locomotive Cable Insulation Life Under Varying Temperature Loading", IEEE Transactions on Industry Applications, vol. No. IA-21, Issue No. 4, pp. 882-888, Jul./Aug. 1985.
Hooper, "Reducing Rail Costs through Innovative Methods", Railway Track and Structures, pp. 14-17, Jul. 1993.
Grizzle et al., "Improved Cylinder Air Charge Estimation for Transient Air Fuel Ratio Control", Proceedings of the American Control Conference, Maryland, vol. No. 2, pp. 1568-1573, Jun. 29, 1994.
Bonissone et al., "Genetic algorithms for automated tuning of fuzzy controllers: A transportation application", Proceedings of the Fifth IEEE International Conference on Fuzzy Systems, Schenectady, NY, USA, vol. No. 1, pp. 574-680, 1996.
Ehsani et al., "Application of electrically peaking hybrid (ELPH) propulsion system to a full-size passenger car with simulated design verification", IEEE Transactions on Vehicular Technology, vol. No. 48, Issue No. 6, pp. 1779-1787, Nov. 1999.
He et al., "On-line Parameter Identification for Freight Train Systems", Aug. 29, 2000.
Franke et al., "An algorithm for the optimal control of the driving of trains", Proceedings of the 39th IEEE Conference on Decision and Control, Sydney Australia, pp. 2123-2127, Dec. 2000.
Dick et al., "Predicting the Occurrence of Broken Rails: A Quantitative Approach", In Proceedings of the American railway engineering and maintenance of way association annual conference, TX, USA, 2000.
Rose et al., "Application and potential of guided wave rail inspection", Defect Detection in Rail, Insight, vol. No. 14, Issue No. 6, pp. 353-358, Jun. 2002.
Aharoni et al., "A Novel high-speed rail inspection system", vol. No. 7, Issue No. 10, pp. 1-8, Oct. 2002.
Coleman, "A System for long haul Optimal Driver Advice", Session 5b: Capacity Planning & Train Scheduling, pp. 5.61-5.69, 2003.
Dick et al., "Multivariate statistical Model for Predicting Occurrence and Location of Broken Rails", Transportation Research Record: Journal of the Transportation Research Board, pp. 48-55, 2003.
Bosch, "Technology explained: the Common Rail diesel injection system", May 2004.
Turner, "Feasibility of Locomotive-Mounted Broken Rail Detection", Final Report for High-Speed Rail Idea Project 38, IDEA, Transportation Research Board of the National Academies, Jun. 2004.
Hou et al., "A Rail Damage Detection and Measurement System Using Neural Networks", IEEE International conference on Computational Intelligence for Measurement Systems and Applications, CIMSA, Boston, MA, USA, pp. 1-9, Jul. 14-16, 2004.
Chan et al., "Trip Optimizer System Description (Rev. 1.1)", Trip Optimizer for Freight Trains Functional Description, pp. 1-24, Nov. 16, 2005.
Non-Final Rejection towards related U.S. Appl. No. 10/736,089 dated Feb. 13, 2006.
Ditmeyer, "Network Centric Railroading Utilizing Intelligent Railroad Systems", World Bank Transport Forum Rail Transport for Development, pp. 1-21, Mar. 31, 2006.
Brawner et al., "Magnetometer Sensor Feasibility for Railroad and Highway Equipment Detection", Innovations Deserving Exploratory Analysis Programs, HSR IDEA Program Final Report, pp. 1-27, Jun. 24, 2006.

(56) References Cited

OTHER PUBLICATIONS

Innotrack, "D4.4.1—Rail Inspection Technologies", Innovative Track Systems, pp. 1-42, Sep. 1, 2006.
Chen et al., "Fault Detection and Diagnosis for Railway Track Circuits Using Neuro-Fuzzy Systems", Control Engineering Practice, vol. No. 16, pp. 585-596, May 2008.
Non-Final Rejection towards related U.S. Appl. No. 11/858,345 dated Jun. 20, 2008.
Ho et al., "Signature Analysis on Wheel-Rail Interaction for Rail Defect Detection", Railway Condition Monitoring, 4th IET International Conference, Hong Kong, pp. 1-6, Jun. 2008.
Non-Final Rejection towards related U.S. Appl. No. 11/858,345 dated Nov. 19, 2008.
sinal Rejection towards related U.S. Appl. No. 10/736,089 dated Dec. 12, 2008.
Unofficial English translation of Notice of Allowance issued in connection with related RU Application No. 2006125429 dated Dec. 22, 2008.
International Search Report and Written Opinion issued in connection with related PCT Application No. PCT/US2008/071958 dated Dec. 30, 2008.
Schafer II, "Effect of Train Length on Railroad Accidents and a Quantitative Analysis of Factors Affecting Broken Rails", 2008.
Non-Final Rejection towards related U.S. Appl. No. 11/858,345 dated Mar. 6, 2009.
Ghanbari et al., "Artificial Neural Networks and regression approaches comparison for forecasting Iran's annual electricity load", Power Engineering, Energy and Electrical Drives, POWERENG, pp. 675-679, Mar. 18-20, 2009.
Unofficial English translation of Office Action issued in connection with related CN Application No. 200480040639.7 dated Apr. 17, 2009.
Kin-Yu et al., "The Research on the Mechanism of Limiting Speed Pick-Up and Set-Out Train on Railway Transportation Capacity Loss", Second International Conference on Intelligent Computation Technology and Automation, Changsha, China, vol. No. 3, pp. 830-833, 2009.
Patra et al., "Availability Analysis of Railway Track Circuits", Proceedings of the Institution of Mechanical Engineers, Part F: Journal of Rail and Rapid Transit, vol. No. 224, Issue No. 3, pp. 169-177, May 1, 2010.
Office Action issued in connection with related AU Application No. 2007333518 dated Aug. 9, 2010.
Non-Final Rejection towards related U.S. Appl. No. 10/736,089 dated Sep. 2, 2010.
Kiaogang et al., "The Research and Application of 1089 t/h Circulating Fluidized Bed Unit Coordinate Control System", International Conference on E-Product E-Service and E-Entertainment (ICEEE), China, 2010.
Xun et al., "The analysis of GSM-R redundant network and reliability models on high-speed railway", International Conference on Electronics and Information Engineering (ICEIE), Beijing, China, vol. No. 2, pp. V2-154-V2-158, 2010.
International Search Report and Written Opinion issued in connection with related PCT Application No. PCT/US2010/048856 dated Feb. 8, 2011.
International Invitation to Pay Additional Fees issued in connection with related PCT Application No. PCT/US10/47251 dated Mar. 4, 2011.
Unofficial English translation of Office Action issued in connection with related RU Application No. 2008110502 dated Mar. 10, 2011.
Unofficial English translation of Office Action issued in connection with related RU Application No. 2007126476 dated Apr. 11, 2011.
Unofficial English translation of Office Action issued in connection with related RU Application No. 2010115501 dated May 26, 2011.
Unofficial English translation of Office Action issued in connection with related RU Application No. 2008109009 dated Aug. 23, 2011.
Non-Final Rejection towards related U.S. Appl. No. 12/027,408 dated Sep. 13, 2011.
International Search Report and Written Opinion issued in connection with related PCT Application No. PCT/US2010/045402 dated Sep. 26, 2011.
Office Action issued in connection with related AU Application No. 2008302642 dated Sep. 29, 2011.
Unofficial English translation of Office Action issued in connection with related RU Application No. 2008125850 dated Sep. 29, 2011.
Non-Final Rejection towards related U.S. Appl. No. 12/365,359 dated Oct. 6, 2011.
Unofficial English translation of Office Action issued in connection with related JP Application No. 2009-511134 dated Oct. 25, 2011.
International Search Report and Written Opinion issued in connection with related PCT Application No. PCT/US2012/044367 dated Apr. 9, 2013.
Non-Final Rejection towards related U.S. Appl. No. 12/365,359 dated Apr. 11, 2013.
Office Action issued in connection with related AU Application No. 2013202194 dated Apr. 17, 2013.
Non-Final Rejection towards related U.S. Appl. No. 12/027,408 dated Apr. 23, 2013.
Unofficial English translation of Office Action issued in connection with related JP Application No. 2012-034736 dated May 14, 2013.
Notice of Allowance issued in connection with related U.S. Appl. No. 12/605,498 dated May 21, 2013.
Non-Final Rejection towards related U.S. Appl. No. 13/171,712 dated May 22, 2013.
Unofficial English translation of Notice of Allowance issued in connection with related RU Application No. 2008109249 dated May 29, 2013.
Notice of Allowance issued in connection with related U.S. Appl. No. 13/175,284 dated Jul. 8, 2013.
Hocking, "Rail Inspection", The Eddy Current Solution, pp. 1-17, Jul. 10, 2013.
Popov, "Automated Ultrasonic Inspection of Rails", pp. 1-5, Jul. 10, 2013.
Sperry, "Sperry B-Scan Dual Rail Inspection System", Sperry Rail Service, For superior technology, training, and reporting, the solution is Sperry, Jul. 10, 2013.
Non-Final Rejection towards related U.S. Appl. No. 12/061,444 dated Aug. 1, 2013.
Non-Final Rejection towards related U.S. Appl. No. 11/831,492 dated Aug. 6, 2013.
Non-Final Rejection towards related U.S. Appl. No. 13/739,133 dated Aug. 28, 2013.
Non-Final Rejection towards related U.S. Appl. No. 13/488,652 dated Sep. 9, 2013.
Non-Final Rejection towards related U.S. Appl. No. 13/344,331 dated Sep. 11, 2013.
Non-Final Rejection towards related U.S. Appl. No. 11/622,136 dated Sep. 12, 2013.
European Search Report and Written Opinion issued in connection with related EP Application No. 11187312.1 dated Oct. 23, 2013.
Notice of Allowance issued in connection with related U.S. Appl. No. 11/831,492 dated Oct. 31, 2013.
Notice of Allowance issued in connection with related AU Application No. 2010260419 dated Nov. 25, 2013.
Notice of Allowance issued in 2013. connection with related U.S. Appl. No. 13/739,133 dated Dec. 11, 2013.
Non-Final Rejection towards related U.S. Appl. No. 13/954,096 dated Dec. 24, 2013.
Zhang et al., "Train Detection by Magnetic Field Sensing", Sensors and Materials, vol. No. 25, Issue No. 6, pp. 123-436, 2013.
International Invitation to Pay Additional Fees issued in connection with related PCT Application No. PCT/US2013/054284 dated Jan. 20, 2014.
Office Action issued in connection with related EP Application No. 07716804.5 dated Jan. 21, 2014.
Notice of Allowance issued in connection with related U.S. Appl. No. 13/344,331 dated Jan. 23, 2014.
Notice of Allowance issued in connection with related U.S. Appl. No. 12/365,359 dated Jan. 28, 2014.

(56) References Cited

OTHER PUBLICATIONS

International Search Report and Written Opinion issued in connection with related PCT Application No. PCT/US2013/054300 dated Feb. 10, 2014.
Non-Final Rejection towards related U.S. Appl. No. 13/778,428 dated Feb. 25, 2014.
International Search Report and Written Opinion issued in connection with related PCT Application No. PCT/US2013/071237 dated Feb. 27, 2014.
Non-Final Rejection towards related U.S. appl. No. 13/653,440 dated Mar. 19, 2014.
Notice of Allowance issued in connection with related U.S. Appl. No. 11/622,136 dated Mar. 27, 2014.
International Search Report and Written Opinion issued in connection with related PCT Application No. PCT/US2013/054284 dated Apr. 1, 2014.
International Invitation to Pay Additional Fees issued in connection with related PCT Application No. PCT/US2013/053124 dated Apr. 2, 2014.
Non-Final Rejection towards related U.S. Appl. No. 13/840,656 dated Apr. 16, 2014.
Non-Final Rejection towards related U.S. Appl. No. 14/016,310 dated Apr. 22, 2014.
Unofficial English translation of Office Action issued in connection with related CN Application No. 201210161080.X dated Apr. 29, 2014.
Non-Final Rejection towards related U.S. Appl. No. 13/171,712 dated May 8, 2014.
Knight, "10-4, Good Computer:Automated System Lets Trucks Convoy as One", MIT Technology Review, May 28, 2014.
Unofficial English translation of Office Action issued in connection with related CN Application No. 201080027403.5 dated Jun. 13, 2014.
International Search Report and Written Opinion issued in connection with related PCT Application No. PCT/US2013/053128 dated Jun. 23, 2014.
Notice of Allowance issued in connection with related U.S. Appl. No. 13/545,271 dated Jun. 26, 2014.
International Search Report and Written Opinion issued in connection with related PCT Application No. PCT/US2013/053124 dated Jul. 4, 2014.
Notice of Allowance issued in connection with related U.S. Appl. No. 13/595,474 dated Aug. 5, 2014.
Notice of Allowance issued in connection with related U.S. Appl. No. 14/016,310 dated Aug. 18, 2014.
Non-Final Rejection towards related U.S. Appl. No. 12/573,141 dated Aug. 29, 2014.
Final Rejection towards related U.S. Appl. No. 13/778,428 dated Sep. 9, 2014.
Non-Final Rejection towards related U.S. Appl. No. 13/618,970 dated Sep. 9, 2014.
Non-Final Rejection towards related U.S. Appl. No. 14/095,373 dated Sep. 16, 2014.
Unofficial English translation of Office Action issued in connection with related CN Application No. 201210356915.7 dated Dec. 2, 2016.
Unofficial English translation of Office Action issued in connection with related RU Application No. 2008108985 dated Oct. 26, 2011.
Unofficial English translation of Office Action issued in connection with related RU Application No. 2008108972 dated Oct. 28, 2011.
Notice of Allowance issued in connection with related AU Application No. 2007333518 dated Nov. 14, 2011.
Final Rejection towards related U.S. Appl. No. 12/061,486 dated Nov. 16, 2011.
Notice of Allowance issued in connection with related U.S. Appl. No. 12/047,427 dated Dec. 30, 2011.
Weart, "Maintenance of Way: Track inspection technology", pp. 1-7, Dec. 2011.
Pan et al., "Full process control strategy of fuel based on water-coal ratio of ultra supercritical units", Electronics, Communications and Control (ICECC), IEEE International Conference, Guangzhou, China, pp. 3750-3753, 2011.
Non-Final Rejection towards related U.S. Appl. No. 12/126,858 dated Jan. 18, 2012.
Non-Final Rejection towards related U.S. Appl. No. 12/061,444 dated Jan. 31, 2012.
Non-Final Rejection towards related U.S. Appl. No. 11/622,136 dated Feb. 27, 2012.
Shanthini et al., "Electromagnetic System for Railroad Track Crack Detection", British Journal of Science, vol. No. 4, Issue No. 1, pp. 49-56, Feb. 2012.
Unofficial English translation of Office Action issued in connection with related JP Application No. 2009-530500 dated Apr. 3, 2012.
Non-Final Rejection towards related U.S. Appl. No. 12/061,486 dated Apr. 4, 2012.
Non-Final Rejection towards related U.S. Appl. No 12/484,278 dated Apr. 5, 2012.
Notice of Allowance issued in connection with related AU Application No. 2008302642 dated May 10, 2012.
Final Rejection towards related U.S. Appl. No. 12/128,249 dated May 15, 2012.
Unofficial English translation of Notice of Allowance issued in connection with related RU Application No. 2008124977 dated Jun. 22, 2012.
Unofficial English translation of Notice of Allowance issued in connection with related RU Application No. 2008110502 dated Jul. 3, 2012.
Unofficial English translation of Office Action issued in connection with related CN Application No. 200980112545.9 dated Sep. 11, 2012.
Non-Final Rejection towards related U.S. Appl. No. 12/052,816 dated Sep. 12, 2012.
Final Rejection towards related U.S. Appl. No. 12/484,278 dated Sep. 20, 2012.
Non-Final Rejection towards related U.S. Appl. No. 12/556,334 dated Sep. 27, 2012.
Unofficial English translation of Office Action issued in connection with related JP Application No. 2009-540342 dated Oct. 2, 2012.
Final Rejection towards related U.S. Appl. No. 12/052,000 dated Oct. 24, 2012.
Unofficial English translation of Office Action issued in connection with related CN Application No. 200780001185.6 dated Oct. 29, 2012.
Unofficial English translation of Office Action issued in connection with related CN Application No. 201010584148.6 dated Oct. 30, 2012.
Final Rejection towards related U.S. Appl. No. 12/027,408 dated Oct. 31, 2012.
Unofficial English translation of Notice of Allowance issued in connection with related RU Application No. 2008125850 dated Oct. 31, 2012.
Non-Final Rejection towards related U.S. Appl. No. 12/061,486 dated Nov. 2, 2012.
Unofficial English translation of Office Action issued in connection with related CN Application No. 201010584140.X dated Nov. 21, 2012.
Notice of Allowance issued in connection with related U.S. Appl. No. 12/484,278 dated Nov. 27, 2012.
Unofficial English translation of Notice of Allowance issued in connection with related RU Application No. 2008108985 dated Dec. 4, 2012.
Office Action issued in connection with related AU Application No. 2010260419 dated Dec. 6, 2012.
Non-Final Rejection towards related U.S. Appl. No. 13/595,474 dated Dec. 11, 2012.
Non-Final Rejection towards related U.S. Appl. No. 12/573,141 dated Dec. 19, 2012.
Unofficial English translation of Notice of Allowance issued in connection with related RU Application No. 2007126476 dated Dec. 21, 2012.

(56) References Cited

OTHER PUBLICATIONS

Unofficial English translation of Office Action issued in connection with related CN Application No. 200880108755.6 dated Dec. 26, 2012.
Unofficial English translation of Office Action issued in connection with related JP Application No. 2009-530500 dated Jan. 8, 2013.
Unofficial English translation of Office Action issued in connection with related JP Application No. 2009-540344 dated Jan. 22, 2013.
Final Rejection towards related U.S. Appl. No. 12/061,444 dated Jan. 31, 2013.
International Invitation to Pay Additional Fees issued in connection with related PCT Application No. PCT/US2012/044367 dated Feb. 1, 2013.
Kun-Peng et al., "Design of transmission system of real-time broken rail detection", Journal of Railway Science and Engineering, vol. No. 10, Issue No. 1, Feb. 2013.
Office Action issued in connection with related AU Application No. 2007253963 dated Mar. 12, 2013.
Final Rejection towards related U.S. Appl. No. 11/622,136 dated Mar. 13, 2013.
Non-Final Rejection towards related U.S. Appl. No. 13/175,284 dated Mar. 18, 2011.
Unofficial English translation of Office Action issued in connection with related MX Application No. MX/a/2012/007335 dated Mar. 21, 2013.
Office Action issued in connection with related AU Application No. 2010292820 dated Mar. 26, 2013.
Notice of Allowance issued in connection with related U.S. Appl. No. 13/529,783 dated Mar. 29, 2011.
Notice of Allowance issued in connection with related U.S. Appl. No. 12/556,334 dated Apr. 3, 2011.
Non-Final Rejection towards related U.S. Appl. No. 13/587,966 dated Apr. 5, 2011.
Non-Final Rejection towards related U.S. Appl. No. 13/565,571 dated Oct. 2, 2014.
Unofficial English translation of Notice of allowance issued in connection with related KZ Application No. 2013/1558.1 dated Nov. 6, 2014.
Notice of Allowance issued in connection with related U.S. Appl. No. 13/618,970 dated Nov. 19, 2014.
Notice of Allowance issued in connection with related AU Application No. 2010292820 dated Nov. 19, 2014.
Maldonado et al., "Autonomous Broken Rail Detection Technology for Use on Revenue Service Trains", U.S. Department of Transportation, Federal Railroad Administration, pp. 1-4, Dec. 2014.
Non-Final Rejection towards related U.S. Appl. No. 13/591,561 dated Feb. 13, 2015.
Final Rejection towards related U.S. Appl. No. 12/573,141 dated Mar. 10, 2015.
Non-Final Rejection towards related U.S. Appl. No. 13/171,712 dated Mar. 10, 2015.
Non-Final Rejection towards related U.S. Appl. No. 14/489,126 dated Apr. 9, 2015.
Notice of Allowance issued in connection with related U.S. Appl. No. 13/653,440 dated Apr. 30, 2015.
Ridgetop Group, "Ridgetop Group Announces New Products for Rail Safety Improvements", pp. 1-2, May 18, 2015.
Final Rejection towards related U.S. Appl. No. 13/591,561 dated Jun. 11, 2015.
Office Action issued in connection with related JP Application No. 2012-034736 dated Jun. 16, 2015.
Non-Final Rejection towards related U.S. Appl. No. 14/491,339 dated Jun. 17, 2015.
Non-Final Rejection towards related U.S. Appl. No. 14/221,624 dated Jun. 19, 2015.
Notice of Allowance issued in connection with related U.S. Appl. No. 14/489,126 dated Jun. 24, 2015.
Non-Final Rejection towards related U.S. Appl. No. 14/527,246 dated Sep. 22, 2015.
Final Rejection towards related U.S. Appl. No. 14/221,624 dated Oct. 05, 2015.
Non-Final Rejection towards related U.S. Appl. No. 13/939,326 dated Oct. 9, 2015.
Office Action issued in connection with related EP Application No. 11187312.1 dated Oct. 15, 2015.
Non-Final Rejection towards related U.S. Appl. No. 14/457,304 dated Oct. 22, 2015.
Sperry, "Sperry B-Scan Single Rail Walking Sticks", Informational pamphlet, Oct. 26, 2015.
Non-Final Rejection towards related U.S. Appl. No. 14/657,233 dated Nov. 18, 2015.
Non-Final Rejection towards related U.S. Appl. No. 14/679,217 dated Dec. 17, 2015.
Non-Final Rejection towards related U.S. Appl. No. 14/696,124 dated Dec. 23, 2015.
Eurasia Search Report and Written Opinion issued in connection with related EA Application No. 201591274 dated Jan. 21, 2016.
Unofficial English translation of Office Action issued in connection with related CN Application No. 201380071077.1 dated Feb. 6, 2016.
Notice of Allowance issued in connection with related U.S. Appl. No. 14/527,246 dated Feb. 23, 2016.
Office Action issued in connection with related AU Application No. 2015200168 dated Mar. 2, 2016.
Notice of Allowance issued in connection with related U.S. Appl. No. 13/591,561 dated Mar. 3, 2016.
Unofficial English translation of Office Action issued in connection with related RU Application No. 2012124894 dated Mar. 9, 2016.
Unofficial English translation of Office Action issued in connection with related CN Application No. 201310220043.6 dated Mar. 14, 2016.
Eurasia Search Report and Written Opinion issued in connection with related EA Application No. 201591504 dated Apr. 6, 2016.
Final Rejection towards related U.S. Appl. No. 14/679,217 dated Apr. 15, 2016.
Non-Final Rejection towards related U.S. Appl. No. 14/457,304 dated May 5, 2016.
Non-Final Rejection towards related U.S. Appl. No. 14/637,513 dated May 19, 2016.
Office Action issued in connection with related EP Application No. 08832181.5 dated Jun. 14, 2016.
International Search Report and Written Opinion issued in connection with related PCT Application No. PCT/US2016/021925 dated Jun. 23, 2016.
Non-Final Rejection towards related U.S. Appl. No. 14/933,659 dated Jun. 30, 2016.
Office Action issued in connection with related AU Application No. 2013216630 dated Aug. 4, 2016.
Unofficial English translation of Notice of Allowance issued in connection with related RU Application No. 2012124894 dated Aug. 5, 2016.
Office Action issued in connection with related AU Application No. 2013299945 dated Aug. 8, 2016.
International Search Report and Written Opinion issued in connection with related PCT Application No. PCT/US2016/031444 dated Aug. 24, 2016.
Non-Final Rejection towards related U.S. Appl. No. 14/657,233 dated Sep. 7, 2016.
Office Action issued in connection with related AU Application No. 2013299501 dated Oct. 7, 2016.
European Search Report and Written Opinion issued in connection with related EP Application No. 16170151.1 dated Oct. 21, 2016.
Notice of Allowance issued in connection with related U.S. Appl. No. 14/679,217 dated Oct. 24, 2016.
Notice of Allowance issued in connection with related U.S. Appl. No. 14/457,304 dated Oct. 28, 2016.
Office Action issued in connection with related IN Application No. 1181/CHENP/2008 dated Nov. 1, 2016.
European Search Report and Written Opinion issued in connection with related EP Application No. 13856206.1 dated Nov. 11, 2016.

* cited by examiner

SYSTEM, METHOD AND COMPUTER SOFTWARE CODE FOR DETERMINING A MISSION PLAN FOR A POWERED SYSTEM USING SIGNAL ASPECT INFORMATION

CROSS-REFERENCE TO RELATED APPLICATIONS

This application claims the benefit of U.S. Provisional Application No. 60/988,191 filed Nov. 15, 2007, and claims priority to and is a Continuation-In-Part of U.S. application Ser. No. 11/765,443 filed Jun. 19, 2007, which claims priority to U.S. Provisional Application No. 60/894,039 filed Mar. 9, 2007, and U.S. Provisional Application No. 60/939,852 filed May 24, 2007, and incorporated herein by reference in its entirety.

U.S. application Ser. No. 11/765,443 claims priority to and is a Continuation-In-Part of U.S. application Ser. No. 11/669,364 filed Jan. 31, 2007, which claims priority to U.S. Provisional Application No. 60/849,100 filed Oct. 2, 2006, and U.S. Provisional Application No. 60/850,885 filed Oct. 10, 2006, and incorporated herein by reference in its entirety.

U.S. application Ser. No. 11/669,364 claims priority to and is a Continuation-In-Part of U.S. application Ser. No. 11/385,354 filed Mar. 20, 2006, and incorporated herein by reference in its entirety.

BACKGROUND OF THE INVENTION

The field of invention relates to a powered system and, more specifically, to reducing fuel consumption and/or emission output of the powered system.

Powered systems, such as, but not limited to, off-highway vehicles, marine powered propulsion plants or marine vessels, rail vehicle systems or trains, agricultural vehicles, and transportation vehicles, usually are powered by a power unit, such as but not limited to a diesel engine. With respect to rail vehicle systems, the powered system is a locomotive, which may be part of a train that further includes a plurality of rail cars, such as freight cars. Usually more than one locomotive is provided as part of the train, where the grouping of locomotives is commonly referred to as a locomotive "consist." Locomotives are complex systems with numerous subsystems, with each subsystem being interdependent on other subsystems.

An operator is usually aboard a locomotive to ensure the proper operation of the locomotive, and when there is a locomotive consist, the operator is usually aboard a lead locomotive. As noted above, a locomotive consist is a group of locomotives that operate together in operating a train. In addition to ensuring proper operations of the locomotive or locomotive consist, the operator is also responsible for determining operating speeds of the train and forces within the train. To perform these functions, the operator generally must have extensive experience with operating the locomotive and various trains over the specified terrain. This knowledge is needed to comply with prescribeable operating speeds that may vary with the train location along the track. Moreover, the operator is also responsible for assuring in-train forces remain within acceptable limits.

However, even with knowledge to assure safe operation, the operator cannot usually operate the locomotive so that the fuel consumption and emissions is minimized for each trip. For example, other factors that must be considered may include emission output, operator's environmental conditions like noise/vibration, a weighted combination of fuel consumption and emissions output, etc. This is difficult to do since, as an example, the size and loading of trains vary, locomotives and their fuel/emissions characteristics are different, and weather and traffic conditions vary.

Based on a particular train mission, when building a train, it is common practice to provide a range of locomotives in the train make-up to power the train, based in part on available locomotives with varied power and run trip mission history. This typically leads to a large variation of locomotive power available for an individual train. Additionally, for critical trains, such as Z-trains, backup power, typically backup locomotives, is typically provided to cover an event of equipment failure, and to ensure the train reaches its destination on time.

Furthermore, when building a train, locomotive emission outputs are usually determined by establishing a weighted average for total emission output based on the locomotives in the train while the train is in idle. These averages are expected to be below a certain emission output when the train is in idle. However, typically, there is no further determination made regarding the actual emission output while the train is in idle. Thus, though established calculation methods may suggest that the emission output is acceptable, in actuality, the locomotive may be emitting more emissions than calculated.

When operating a train, train operators typically call for the same notch settings when operating the train, which in turn may lead to a large variation in fuel consumption and/or emission output, such as, but not limited to, $NO_x$, $CO_2$, etc., depending on a number of locomotives powering the train. Thus, the operator usually cannot operate the locomotives so that the fuel consumption is minimized and emission output is minimized for each trip since the size and loading of trains vary, and locomotives and their power availability may vary by model type.

Wayside signaling systems are used to communicate signal aspect information to a train as it travels along a railway route. Such transmitted information is further used in operating the train. One type of wayside signaling system features a continuous succession of DC train detection circuits along the entire length of the railway route through which to control a multiplicity of wayside signal devices spaced apart from each other along the route. Each train detection circuit covers a section of track and is electrically isolated from the next detection circuit via an insulated joint situated between each track section. Each train detection circuit merely detects whether its section of track is occupied by a train and communicates a signal indicative of the same to its corresponding wayside signal device. For this type of wayside signaling system, each wayside signal device typically takes the form of a display of colored lights or other indicia through which to visually communicate signal aspect information to a train operator. It is the signal aspect information that denotes the condition of the upcoming segment of track, e.g., whether it is clear, occupied by a train, or subject to some other speed restriction. Each signal aspect is conveyed by a color or combination of colors and denotes a particular course of action required by the operating authority. The particular colors of red, yellow, and green generally denote the same meaning as when used on a standard road traffic light. The signal aspect information is either viewed by the operator, or a video system captures the light signal and processes the information, which is then relayed to the operator.

Another type of wayside signaling system features a continuous succession of DC train detection circuits along the railway track route, which are used to control the wayside signal devices spaced along the route. Each of the wayside signal devices in this type of signaling system also includes an AC track circuit that accompanies or overlays each DC train detection circuit and serves to supplement its visual display. Through its AC track circuit, each wayside signal device communicates the signal aspect information over the rails as a cab signal. As a train rides on the rails, the cab signal is sensed by pick up coils mounted in front of the leading axle of the locomotive. The cab signal is filtered, decoded, and eventually conveyed to a cab signal device located in the cab of the locomotive. The cab signal device typically includes a display of colored lights to convey visually the signal aspect information so that the train operator will be kept apprised of the signal aspect applicable to the upcoming segment of track.

Another type of wayside signaling system features a continuous succession of DC train detection circuits along the railway track route, which are used to control the wayside signal devices spaced along the route. In this type of wayside signaling system, however, each of the wayside signal devices controls a track transponder located at a fixed point along the track before each wayside signal device. When a train is detected on a section of track, the train detection circuit corresponding thereto informs its corresponding wayside signal device. The train, however, can only receive the signal aspect information from the transponder as it passes by each fixed point. By using the track transponders to transmit additional encoded data, such as but not limited to the profile of the upcoming track segment and the signal block length, a train equipped with an automatic train protection system is able to enforce braking on routes covered by such a wayside signaling system.

A train owner usually owns a plurality of trains, wherein the trains operate over a network of railroad tracks. Because of the integration of multiple trains running concurrently within the network of railroad tracks, wherein scheduling issues must also be considered with respect to train operations, train owners would benefit from a way to optimize fuel efficiency and emission output so as to save on overall fuel consumption while minimizing emission output of multiple trains while meeting mission trip time constraints even as track information is provided via signal aspect information.

Wayside signaling devices that provide signal aspect information may also be used with other powered systems such as, but not limited to, off-highway vehicles, marine vessels, agricultural vehicles, transportation vehicles, etc. Similarly, owners and/or operators of such powered systems would appreciate the financial benefits realized when these powered systems produce optimize fuel efficiency and emission output so as to save on overall fuel consumption while minimizing emission output while meeting operating constraints, such as but not limited to mission time constraints, even as route information is provided via signal aspect information.

BRIEF DESCRIPTION OF THE INVENTION

Embodiments of the present invention relate to a system, method, and a computer readable media for determining a mission plan for a powered system, using signal aspect information received from a remote location during the mission. ("Remote" refers to a location not on or in the powered system.) The system includes a receiving device to collect aspect information as the powered system performs a mission. The system also includes a processor to determine a speed limit based at least in part on the aspect information. A control system is connected to the powered system to operate the powered system in response to the speed limit (e.g., the determined speed limit received from the processor).

In another embodiment, the method includes receiving a speed limit or the signal aspect information from the remote location at the powered system. A speed limit is determined based at least in part on the signal aspect information. The mission plan (e.g., originally generated by the control system) is re-planned to comply with the speed limit and at least one other mission objective. The powered system is operated based on the re-planned mission plan.

In another embodiment, the computer software code is stored on a computer readable media and is executed with a processor. The computer software code includes a computer software module for determining a speed limit based at least in part on the signal aspect information received from the remote location, when executed with the processor. A computer software module for re-planning the mission plan to comply with the speed limit and at least one other mission objective, when executed with the processor, is also provided. The computer software code also includes a computer software module for operating the powered system based on the re-planned mission plan, when executed with the processor.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, exemplary embodiments of the invention will be described and explained with additional specificity and detail through the use of the accompanying drawings in which.

DETAILED DESCRIPTION OF THE INVENTION

Figure 1:
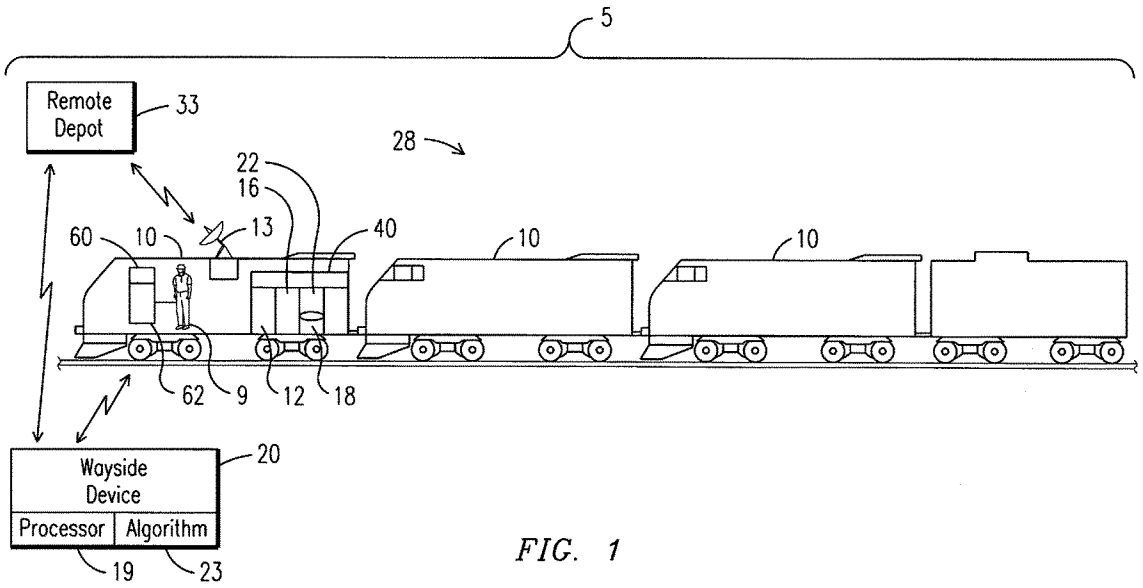
FIG. 1 is a schematic diagram of a mission planner system for determining a mission plan for a powered system using signal aspect information, according to an embodiment of the present invention.

Though exemplary embodiments of the present invention are described with respect to various powered systems, including rail vehicles, specifically trains and locomotives having diesel engines, exemplary embodiments of the invention are also applicable for other powered systems, such as but not limited to off-highway vehicles, marine vessels, agricultural and transportation vehicles, and stationary power units, each which may use a diesel or other engine. Towards this end, when discussing a specified mission, this includes a task or requirement to be performed by the powered system. Therefore, with respect to railway vehicle applications, marine vessel applications, off-highway vehicle applications, agricultural vehicle applications, and/or transportation vehicle applications, this may refer to the movement of the powered system from a present location to a destination.

Each powered system disclosed above may use at least one diesel engine or diesel internal combustion engine and may have a plurality of alternators. Even though diesel powered systems are disclosed, those skilled in the art will readily recognize that embodiments of the invention may also be utilized with non-diesel powered systems, such as but not limited to natural gas powered systems, bio-diesel powered systems, etc. Furthermore, as disclosed herein such non-diesel powered systems, as well as diesel powered systems, may include multiple engines, other power sources, and/or additional power sources, such as, but not limited to, battery sources, voltage sources (such as but not limited to capacitors), chemical sources, pressure based sources (such as but not limited to spring and/or hydraulic expansion), current sources (such as but not limited to inductors), inertial sources (such as but not limited to flywheel devices), gravitational-based power sources, and/or thermal-based power sources.

In one exemplary embodiment involving marine vessels, a plurality of tugs may be operating together where all are moving the same larger vessel, where each tug is linked in time to accomplish the mission of moving the larger vessel. In another exemplary embodiment a single marine vessel may have a plurality of engines. Off-highway vehicle (OHV) applications may involve a fleet of vehicles that have a same mission to move earth, from location "A" to location "B," where each OHV is linked in time to accomplish the mission.

Exemplary embodiments of the invention solve the problems in the art by providing a system, method, and computer implemented method, such as a computer software code, for transmitting signal aspect information from a remote location to a powered system to control, such as through a mission optimization system, a characteristic of the powered system, such as but not limited to efficient fuel consumption and/or emission improvement. With respect to locomotives, exemplary embodiments of the present invention are also operable when the locomotive consist is in distributed power operations.

Persons skilled in the art will recognize that an apparatus, such as a data processing system, including a CPU, memory, I/O, program storage, a connecting bus, and other appropriate components, could be programmed or otherwise designed to facilitate the practice of the method of the invention. Such a system would include appropriate program means for executing the method of the invention.

Also, an article of manufacture, such as a pre-recorded disk or other similar computer program product, for use with a data processing system, could include a storage medium and program means recorded thereon for directing the data processing system to facilitate the practice of the method of the invention. Such apparatus and articles of manufacture also fall within the spirit and scope of the invention.

Broadly speaking, a technical effect is optimizing an operating characteristic, such as but not limited to fuel efficiency and/or emission output, by including signal aspect information to re-plan a mission during the actual mission of a powered system. To facilitate an understanding of the exemplary embodiments of the invention, it is described hereinafter with reference to specific implementations thereof. Exemplary embodiments of the invention may be described in the general context of computer-executable instructions, such as program modules, being executed by a computer. Generally, program modules, or computer software modules, include routines, programs, objects, components, data structures, etc. that perform particular tasks or implement particular abstract data types. For example, the software programs, or computer software code, that underlie exemplary embodiments of the invention can be coded in different languages, for use with different platforms. It will be appreciated, however, that the principles that underlie exemplary embodiments of the invention can be implemented with other types of computer software technologies as well.

Moreover, those skilled in the art will appreciate that exemplary embodiments of the invention may be practiced with other computer system configurations, including hand-held devices, multiprocessor systems, microprocessor-based or programmable consumer electronics, minicomputers, mainframe computers, and the like. Exemplary embodiments of the invention may also be practiced in distributed computing environments where tasks are performed by remote processing devices that are linked through a communications network. In a distributed computing environment, program modules may be located in both local and remote computer storage media including memory storage devices. These local and remote computing environments may be contained entirely within the locomotive, or adjacent locomotives in consist, or off-board in wayside or central offices where wireless communication is used.

Throughout this document the term "locomotive consist" is used. As used herein, a locomotive consist may be described as having one or more locomotives in succession, connected together so as to provide motoring and/or braking capability. The locomotives are connected together where no train cars are in between the locomotives. The train can have more than one locomotive consist in its composition. Specifically, there can be a lead consist and one or more remote consists, such as midway in the line of cars and another remote consist at the end of the train. Each locomotive consist may have a first locomotive and trail locomotive(s). Though a first locomotive is usually viewed as the lead locomotive, those skilled in the art will readily recognize that the first locomotive in a multi locomotive consist may be physically located in a physically trailing position. Though a locomotive consist is usually viewed as successive locomotives, those skilled in the art will readily recognize that a consist group of locomotives may also be recognized as a consist even when at least a car separates the locomotives, such as a tender car for storing an energy/fuel source, or such as when the locomotive consist is configured for distributed power operation, wherein throttle and braking commands are relayed from the lead locomotive to the remote trains by a radio link or physical cable. Towards this end, the term locomotive consist should be not be considered a limiting factor when discussing multiple locomotives within the same train.

A wayside signal or other device is also disclosed below. Even though the wayside device is disclosed specific to a rail vehicle system, the wayside device may be any device that is proximate a route that a powered system travels. For example, with respect to a marine vessel, the wayside device may be a buoy.

Referring now to the drawings, embodiments of the present invention will be described, consistent with the invention, examples of which are illustrated in the accompanying drawings. Wherever possible, the same reference numerals used throughout the drawings refer to the same or like parts. Exemplary embodiments of the invention can be implemented in numerous ways, including as a system (including a computer processing system), a method (including a computerized method), an apparatus, a computer readable medium, a computer program product, a graphical user interface, including a web portal, or a data structure tangibly fixed in a computer readable memory. Several embodiments of the invention are discussed below.

FIG. 1 depicts a diagram illustrating exemplary elements used for optimizing parameters with signal aspect information. More generally, FIG. 1 depicts a mission planner system for a powered system, which may carry out a process for optimizing at least one parameter associated with operations of the powered system during a mission. Though the diagram in FIG. 1 is specific to a rail vehicle system, as discussed above, the elements disclosed in FIG. 1 are applicable to other powered systems. With respect to the rail vehicle system, signal aspect information is provided to a train control system 12, such as but not limited to an incremental train control system ("ITCS"), located on a locomotive 10. A receiving device 13 (e.g., communication device) is provided on the locomotive 10 to receive the aspect information. For providing the signal aspect information, a wayside device 20 (such as but not limited to a vital wayside device) executes one or more logic operations installed as part of a control process on the wayside device. Those skilled in the art will readily recognize that the logic operations may be embodied in computer-readable instructions, such as an algorithm 23, that when executed by a processor 19 in the wayside device cause the processor 19 to quantify the aspect information (e.g., generate data containing information about the signal status of the wayside device) and transmit the aspect information for receipt by and use in operating the locomotive 10. For example, the parameters that identify specific aspect information to be used to operate the locomotive 10 are received by the receiving device and mapped to a database 18 on the train 5 that contains, but is not limited to, such information as the signal information and facing direction of the signal, i.e., traffic that the signal is controlling. Mapping or otherwise cross-referencing the aspect information to the database 18 identifies how to translate the aspect of a signal in a message that is transmitted from a wayside device 20 to the locomotive 10. A processor 16 is positioned on the train 5 to facilitate the mapping. The aspect information may be further assigned a specific speed limit within the database 18, such as but not limited to an aspect information-to-speed limit spreadsheet, which is in turn used to govern the speed of the locomotive 10.

Put another way, the database 18 includes a list or other data structure of various aspect information expected to be received from wayside devices 20. Correlated with each aspect information is a respective, designated speed limit. When aspect information is received by the receiving device 13, the processor 16 cross-references the received aspect information to the database 18 to determine the speed limit corresponding to the received aspect information. The control system 12 controls the locomotive/train in response to the determined speed limit, e.g., the locomotive/train is controlled so that the determined speed limit is not exceeded by the locomotive/train.

Based on the example above, the control system 12 includes the processor 16. Additionally, a memory storage device 22 is provided for storing the database 18. Though FIG. 1 illustrates the control system 12, processor 16, and memory storage device 22 as being either an integrated unit or located on a single locomotive 10, those skilled in the art will readily recognize that each of these systems may be independent units located on different locomotives but linked together, either through a wired or a wireless communication system. In either instance, the control system 12, processor 16, and receiving device 13 are at least functionally part of the mission planner system, which, as noted above, determines a mission plan for controlling a mission of the powered system.

When the locomotive 10 approaches the location of a signal, such as but not limited to the wayside device 20 that provides the signal, the signal aspect information is transmitted in a message from the wayside device 20 to the locomotive 10, where it is collected (e.g., received) by the receiving device 13. Though signal aspect information is primarily disclosed herein as originating from the wayside device 20, those skilled in the art will readily recognize that signal aspect information may originate from any device located along a route traveled by the locomotive. For example, a remote depot 33 may be an origin of the signal aspect information. Thus, in a broad sense, the aspect information is received by the receiving device from a remote location 20, 33, wherein by "remote" it is meant a location not on or in the train or other powered system.

The processor 16 extracts the aspect information from the message received from the wayside device 20. The message may be stored in the database 18 prior to or even after the aspect information is obtained. The corresponding speed associated with particular aspect information is then provided to enforce an allowable train speed. The corresponding speed may be displayed to an operator 9 aboard the train 5 to enforce the allowable train speed and/or provided to a trip optimization system 40 to enforce the allowable train speed.

This same speed limit that is associated with the signal aspect information can be used to determine the speed at which the locomotive should be traveling to optimize fuel consumption. In an exemplary embodiment, the speed limit associated with the aspect information may be greater than the current train speed. In this situation a fuel optimization algorithm, provided in the trip optimization system 40, may provide a new speed setting for increasing the train speed appropriately. As discussed above, application of the new speed setting may be accomplished manually or through the trip optimization system 40. An example of the trip optimization system 40 is disclosed in U.S. Application Publication No. 20070219680, dated Sep. 20, 2007, incorporated by reference herein in its entirety.

When the speed limit associated with the signal location is lower than the current train speed, sufficient brake pressure can be applied to reduce the train speed appropriately. As with increasing speed based on signal location, decreasing speed may be accomplished either manually and/or with the trip optimization system. Additionally, the trip optimization system 40 may further calculate a speed for the locomotive 10 which optimizes emission output or fuel consumption while satisfying the aspect information speed restriction and meeting other mission objectives. The trip optimization system 40 may be a device separate from the control system 12 or may be part of the control system 12.

Figure 2:
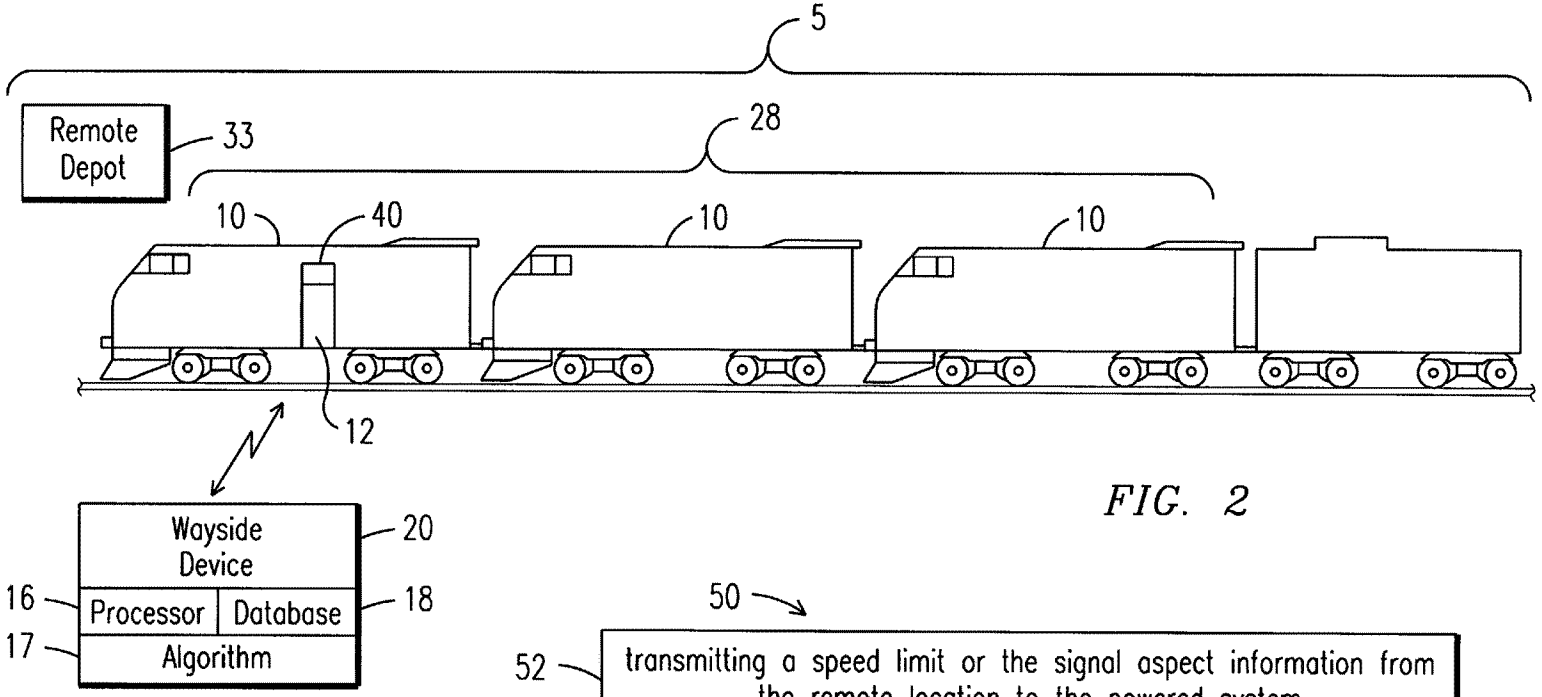
FIG. 2 is a schematic diagram of another embodiment of the mission planner system.

FIG. 2 depicts another diagram illustrating exemplary elements used for optimizing at least one parameter associated with operation of a powered system using signal aspect information, according to an embodiment of the present invention. As illustrated, the processor 16, algorithm 17, and database 18 are located at the wayside device 20 instead of on the train. In this embodiment, processing to determine a speed limit is performed at the wayside device 20 and the speed limit information is transmitted to the locomotive 10 where it is provided directly to the control system 12 for inclusion in re-planning the mission plan. In this embodiment, all determinations, or calculations, are made at the wayside device.

As disclosed above with respect to FIG. 1, signal aspect information provides information about a forthcoming track segment where the information is not specific to a train 5. With respect to a locomotive consist 28, the control system 12 may include an algorithm (or, more specifically, computer-readable instructions) that when executed by the processor 16 causes the processor 16 to determine speed settings for each locomotive 10 in the locomotive consist 28 based on the signal aspect information received. In another exemplary embodiment, the received signal aspect information may include information specific to a plurality of locomotive consists 28. In this example, the control system 12 has an algorithm, or more specifically computer-readable instructions, that when executed by the processor 16 causes the processor to evaluate the information received, and based on locomotive consist information specific to the train 5, to select speed settings for each locomotive 10 based on the signal aspect information.

A plurality of communication techniques may be used for transmitting signal aspect information to the mission planner system. Such techniques may include, but are not limited to, in combination or individually, an axle counter information transmitted from the wayside device 20 or from another remote location (such as but not limited to a remote depot 33) to the receiving device 13, and/or baseline information, or another track-installed cab signaling device where information is transmitted from the wayside device 20 or from the remote depot 33 to the receiving device 13. The remote depot 33 may have a control system that communicates directly to the train 5, or through a wayside device 20 to the train 5.

In another embodiment the communication system uses signal light information transmitted directly to the locomotive. Other methods of transmission may include, but are not limited to, satellite transmission, millimeter wave transmission, Global System for Mobile communications ("GSM") and Code Division Multiple Access ("CDMA") or other cellular network-based communications, visual indications directly to the train driver or operator 9, acoustic transmission either over the air or through the rails, signal light transmissions directly to the locomotive 10 where the light is modulated to indicate the aspect, vehicle-to-vehicle transmissions relaying aspect information from trains on the same track or from trains on adjacent tracks, vibration (i.e., sound energy transmitted either over the air or through the rails), electromagnetic energy either pulsed or constant that can be transmitted from a wayside device 20 or trains 30, and/or heat signature on the track and using the rate of decay of the heat to determine potential aspect information from trains on the same track and trains using adjacent tracks.

Figure 3:
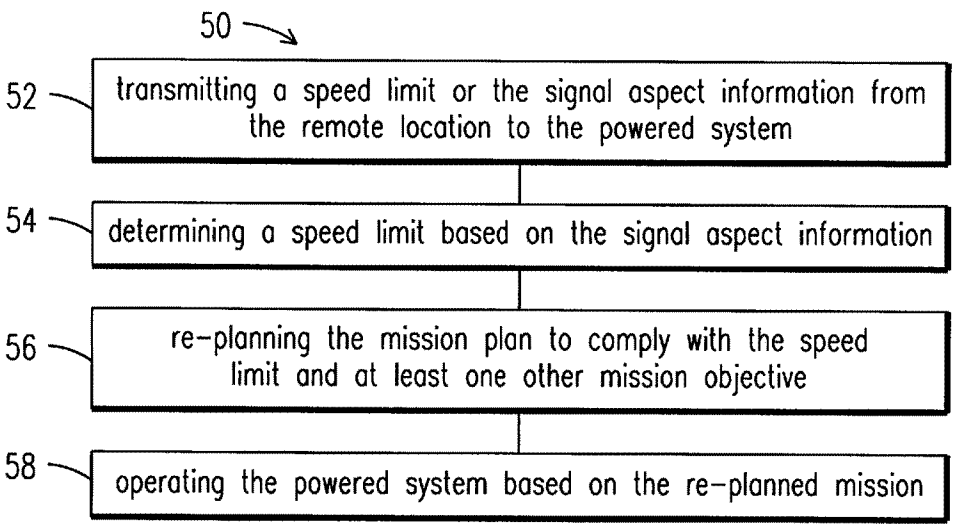
FIG. 3 depicts a flowchart illustrating a method for determining a mission plan for a powered system using signal aspect information, according to an embodiment of the present invention.

FIG. 3 depicts a flowchart illustrating a method for determining a mission plan for a powered system, using signal aspect information, and which may include optimizing at least one parameter associated with operation of the powered system during the mission, according to an embodiment of the present invention. As disclosed above, the speed limit may be determined from the signal aspect information at the remote location, e.g., the wayside device 20 or remote depot 33, or aboard the locomotive. Therefore, the flowchart 50 illustrates transmitting a speed limit or the signal aspect information from the remote location to the powered system, at 52. The speed limit is determined based at least in part on the signal aspect information, at 54. (That is, the speed limit is determined based on the signal aspect information, but may also be based on other factors, such as time of day or date and weather conditions.) The mission plan is re-planned to comply with the speed limit and at least one other mission objective, such as but not limited to mission duration, mission duration for a certain segment, other speed requirements, fuel use, etc., at 56. The powered system is operated based on the re-planned mission, at 58. Transmitting signal aspect information, at 52, determining the speed limit, at 54, re-planning the mission, at 56, and operating the powered system, at 58 may be performed in a closed-loop process, or using a closed-loop technique.

When implemented through the closed-loop process, and as further illustrated in FIG. 1, a notification system 60, such as a display, is provided to allow the operator 9 to witness changes associated with re-planning. Those skilled in the art will readily recognize the notification system may incorporate a plurality of techniques to notify the operator when the speed has changed in response to a change of speed limits. Such techniques may include visual, touch, sound, and/or smell. A control device 62 is available to the operator 9 to allow the operator 9 to take control of the train 5, if the operator 9 would prefer to operate the train 5 manually. As disclosed above, the method illustrated in FIG. 3 may be performed with a computer software code having computer software modules. The computer software code is stored on a computer readable media and is operable with a processor, where the processor is specifically designed to perform the functions disclosed herein.

An embodiment of the present invention relates to a computer software code stored on a computer readable media. The computer software code is configured for execution with a processor 16 designated for determining a mission plan for a powered system using aspect information obtained from a remote location during a mission. The computer software code comprises a computer software module for determining a speed limit based on the signal aspect information received from the remote location, when executed with the processor. The computer software code also comprises a computer software module for re-planning the mission plan to comply with the speed limit and at least one other mission objective, when executed with the processor. The computer software code also comprises a computer software module for operating the powered system based on the re-planned mission plan, when executed with the processor.

In another embodiment, the re-planned mission plan is optimized in regards to at least one parameter associated with operation of the powered system during the mission.

While the invention has been described herein with reference to various exemplary embodiments, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc., do not denote any order or importance, but rather the terms first, second, etc., are used to distinguish one element from another.

What is claimed is:

1. A system comprising:

a receiving device configured to collect signal aspect information for a powered system that performs a mission, wherein the signal aspect information denotes a traffic condition of at least one segment on which the powered system is configured to pass, the signal aspect information being received from a remote location;

one or more processors configured to determine a speed limit of the powered system based at least in part on the signal aspect information; and a control system connected to the powered system configured to operate the powered system in response to the speed limit, wherein the control system is configured to increase a speed of the powered system if the speed limit determined is greater than a current speed of the powered system, wherein the control system is configured to generate a mission plan for controlling the mission of the powered system, the mission plan specifying motoring power settings for plural segments over which the powered system is configured to pass in addition to the at least one segment on which the powered system is configured to pass; and the mission plan is re-planned when the speed limit is determined, based at least in part on the signal aspect information received by the receiving device, wherein re-planning the mission plan comprises re-planning at least one of the motoring power settings.

2. The system according to claim 1, wherein the powered system is configured to be operated by the control system in accordance with the speed limit, and where emissions output or fuel consumption of the powered system is reduced while at least one mission requirement other than the speed limit is met.

3. The system according to claim 1, further comprising one or more computer readable instructions that when executed by the one or more processors cause the one or more processors to quantify the signal aspect information and provide the speed limit associated with the signal aspect information.

4. The system according to claim 1, wherein the powered system comprises a railway system, a marine vessel, an off-highway vehicle, a transportation vehicle, or an agricultural vehicle.

5. The system according to claim 1, wherein the control system operates in a closed loop process.

6. The system according to claim 1, further comprising a manual controller configured to allow for optional manual control of the powered system.

7. The system according to claim 1, further comprising a notification system configured to notify an operator when a speed of the powered system is changed in response to the speed limit.

8. A system comprising:

a receiving device configured to collect signal aspect information for a powered system that performs a mission, wherein the signal aspect information denotes a traffic condition of at least one segment on which the powered system is configured to pass, the signal aspect information being received from a remote location;

one or more processors configured to determine a speed limit of the powered system based at least in part on the signal aspect information;

a control system connected to the powered system configured to operate the powered system in response to the speed limit, wherein the control system is configured to increase a speed of the powered system if the speed limit determined is greater than a current speed of the powered system; and a data storage device connected to at least one of the processor or the control system and configured to at least one of store a database used to determine the speed limit or store the signal aspect information.

* * * * *